US005808559A

United States Patent [19]

Buckler

[11] Patent Number: 5,808,559

[45] Date of Patent: Sep. 15, 1998

[54] MONITOR FOR FLUID DISPENSING SYSTEM

[75] Inventor: Jeffrey M. Buckler, Stow, Ohio

[73] Assignee: Nordson Corporation, Westlake, Ohio

[21] Appl. No.: 785,421

[22] Filed: Jan. 23, 1997

Related U.S. Application Data

[60] Continuation of Ser. No. 547,899, Oct. 24, 1995, abandoned, which is a division of Ser. No. 218,675, Mar. 28, 1994, Pat. No. 5,481,260.

[51] Int. Cl.[6] ..... G08B 19/00

[52] U.S. Cl. ..... 340/870.09; 340/606; 340/611; 340/614; 340/626; 340/609

[58] Field of Search ..... 340/606, 609, 340/611, 614, 626, 870.09; 239/71, 72, 73; 73/361.03; 364/510; 222/373

[56] References Cited

U.S. PATENT DOCUMENTS

| | | | |
|---|---|---|---|
| 3,726,711 | 4/1973 | Hogstrom | 427/233 |
| 3,765,567 | 10/1973 | Maiocco et al. | 222/30 |
| 4,055,844 | 10/1977 | Hornbostel | 340/611 |
| 4,430,886 | 2/1984 | Rood | 73/37 |
| 4,481,503 | 11/1984 | Lehman et al. | 340/606 |
| 4,489,311 | 12/1984 | Lang et al. | 340/501 |
| 4,494,112 | 1/1985 | Streib | 340/606 |
| 4,495,488 | 1/1985 | Streib | 340/606 |
| 4,662,540 | 5/1987 | Schroter | 340/606 |
| 4,668,948 | 5/1987 | Merkel | 340/606 |
| 4,788,648 | 11/1988 | Ferreti et al. | 340/618 |
| 4,827,430 | 5/1989 | Aid et al. | 340/606 |
| 4,917,296 | 4/1990 | Konieczynski | 239/1 |
| 4,951,224 | 8/1990 | Hokynar | 340/606 |
| 4,972,180 | 11/1990 | Akai et al. | 340/606 |
| 5,446,449 | 8/1995 | Lhomer et al. | 340/606 |
| 5,483,596 | 1/1996 | Rosenow et al. | 380/25 |
| 5,504,693 | 4/1996 | Elliot et al. | 340/606 |
| 5,592,396 | 1/1997 | Tambini et al. | 364/510 |

FOREIGN PATENT DOCUMENTS

| | | |
|---|---|---|
| 0119057 | 9/1984 | European Pat. Off. . |
| 0222258 | 5/1997 | European Pat. Off. . |
| 61-278373 | 9/1986 | Japan . |
| 9108544 | 6/1991 | WIPO . |

OTHER PUBLICATIONS

Patent Abstracts of Japan, vol. 11, No. 139 (C–420) (2586) 7 May 1987 and JP, A, 61 278 373 (Nordson K.K.) 9 Dec. 1986.

ISA Transactions vol. 2B, No. 3, 1989, Pittsburgh US pp. 33–40, M. Arnold et al. "Alarm Management in Batch Process Control".

Technical Publication pp. 17–6–1 thru 17–6–1 issued Sep./1984, Nordson Corporation, Model NFS–1 Flow Sentry Control.

Product Information Brochure Nordson Corp., Model NFS–1 Flow Sentry System.

*Primary Examiner*—Jeffrey Hofsass
*Assistant Examiner*—Ashok Mannava
*Attorney, Agent, or Firm*—Wood, Herron & Evans, L.L.P.

[57] ABSTRACT

Apparatus and methods for monitoring a characteristic of fluid flow through a fluid dispenser that permit adverse flow conditions to be monitored, analyzed and displayed to an operator. The monitor samples either the static or firing pressure a predetermined number of times and calculates an average static and firing pressure over the sampling period. The average pressure values are compared to high and low warning and alarm limits and warning and alarm error codes are produced as a function thereof. In addition, individual sampled values are compared to the high and low warning and alarm limits and pressure values exceeding the limits during a sampling period are counted. Warning and alarm error codes are produced as a function of the counted values exceeding predetermined count values. The monitor control system discriminates between alarm conditions requiring immediate remedial attention and warning conditions the progress of which may be tracked and remedial action taken prior to an alarm condition occurring. Each fluid dispenser has a fluid monitor connected to a remote operator control with a data communications network. Consequently, an operator may monitor all of the monitor controls from a remote location. The monitor provides diagnostics that provide suggestions to the operator of potential causes of the particular adverse flow condition detected. Further, the monitor provides a more reliable calibration method and a swivel mounting for a attaching a sensor to the dispensing unit.

21 Claims, 10 Drawing Sheets

MONITOR FOR FLUID DISPENSING SYSTEM

This application is a continuation of prior application Ser. No. 08/547,899 filed Oct. 24, 1995, now abandoned, which is a division of application Ser. No. 08/218,675 filed on Mar. 28, 1994, now U.S. Pat. No. 5,481,260.

BACKGROUND OF THE INVENTION

The invention relates to monitoring devices and more particularly, to methods and apparatus for detecting malfunctions in the operation of fluid dispensers.

Typical fluid dispensing systems in one form include a pump having an inlet connected to a supply of material and a discharge connected to a fluid dispenser. For precision dispensing, the dispenser may include a valve which permits fluid to pass through a discharge opening such as a spray nozzle or fluid tip. In some systems, the dispenser valve is operated by a programmed control device so that fluid is dispensed in precise or metered amounts.

In many applications it is often desirable that precise patterns, metered amounts or both be dispensed. In operation, precision or accurate metering is affected by many factors including nozzle wear, fluid impurities, nozzle clogging, and pump performance. Clogging of the material flow path, especially in the dispenser, is a typical problem that adversely affects the performance of precision dispensing systems. For example, in precision dispensing systems used to coat the interior surface of multipiece can bodies, a clogged or worn spray nozzle may cause the can body to be incompletely or improperly coated.

The can bodies are typically coated during the manufacturing process at rates of up to several hundred cans per minute. Thus, an improperly functioning dispenser, and more particularly, a clogged or worn nozzle can result in many improperly coated cans before detection of the fluid dispenser malfunction. An improperly coated can may have an adverse effect on the can's ability to function for storage. In some cases, the can may suffer accelerated deterioration (i.e., shortened shelf life), and in others (e.g. for foods and beverages) the contents may be adversely affected (e.g., taste, spoilage). Improper coating, therefore, is undesirable and adds substantial expense because improperly coated cans must be rejected and disposed of, or reprocessed by inspecting, hand sorting, cleaning and recoating.

The above problems are addressed by the fluid dispenser monitor described in U.S. Pat. No. 4,668,948 issued on May 26, 1987 to S. L. Merkel which is assigned to the assignee of this invention. The monitor utilizes an analog control system in which a calibrated orifice is used to provide, during the gun ON time, a small pressure drop from the static pressure set by the operator. The pressure is measured between the nozzle and the calibrated orifice both during the gun ON and OFF times to monitor fluid flow conditions through the gun. During the ON time, the pressure drop across the orifice may, for example, be approximately 50–60 pounds per square inch ("psi") given a static pressure of, for example, 800 psi. As the gun is turned ON and OFF to coat each successive can, the magnitude of the firing pressure is compared to a reference signal to detect adverse flow and pressure conditions. A counter is used to sense a predetermined number of firing pressure fault conditions before an error signal is generated.

The control system is operative during the coating process to create a alarm error signals if the firing pressure detected by the pressure transducer is greater than predetermined high or low pressure reference signals. Adverse flow conditions may result from worn or clogged nozzles; and when the detected pressure signal exceeds the pressure reference signal, alarm signals are generated to the operator. The monitor includes an adjustment for varying the sensitivity of the detection process by changing the magnitude of the predetermined pressure reference signals. The control can also be set to detect a rapid excursion of the measured firing pressure which represents an excessive pressure loss or no pressure signal. Further, when the fluid dispenser is closed, that is, OFF, the same pressure transducer is monitored to detect a pump malfunction. In any of the above situations, the error signal produced is effective to terminate the operation of the fluid dispenser.

The pressure transducer typically used in the analog monitor control described above produces a low level output signal. However, the transducer is located in an environment with the potential for high levels of electrical noise; and therefore, a preamplifier must be located within several feet of the pressure measuring transducer which is attached to the fluid dispenser. In addition, as with most analog systems, the monitor control is susceptible to noise and has a tendency to drift which makes calibration difficult and subject to inadvertent change. Further, in order to obtain a more reliable detection of poorly coated cans, the monitor must detect an unsatisfactory firing pressure over at least two fluid dispensing cycles before a coating error signal is produced. Consequently monitoring the quality of the fluid dispensing cycle on a cycle by cycle, that is, can by can basis, is not available.

A fluid dispensing monitoring system that overcomes some of the disadvantages of the above system is disclosed in Japanese publication No. 61-278373(A) which is assigned to a subsidiary of the assignee of the present invention. With that monitor, a processing unit samples a pressure signal from the fluid dispenser a predetermined number of times while the fluid is being dispensed. Each sampled pressure signal is compared to upper and lower limits of an acceptable pressure range. Further, each of the sampled pressure signals that exceed the upper and lower limits of the acceptable pressure range are individually counted. The control system requires that a predetermined number of sample pressure signals exceed either of the upper or lower limits before an alarm is given. Further, the above sampling process can be used to sample the current and voltage of the solenoid for the flow control valve which is used to open and close the fluid dispenser thereby providing an indication of whether the flow control valve is operating properly.

While the above sampling monitoring system has advantages over the prior analog monitoring control system, it continues to share many disadvantages of prior monitoring control systems for fluid dispensers. While prior controls detect alarm conditions requiring corrective action, the prior controls do not provide a comprehensive methodology of collecting data to provide warning information regarding a pending potential malfunction and what the source of the malfunction may be. Further, prior control systems require that production line operators monitor each individual fluid dispenser at its physical location; and there is no capability of monitoring the status of one or more of the monitor controls at a remote location. Further, with prior systems, each fluid dispenser on the production line has its own monitor control; and while each control system is connected to other process control devices, such as, alarm lights and other indicators, there is little or no detailed information provided to the production line operator with regard to identifying a particular malfunction or the diagnosis of a malfunction. In addition, the prior pressure monitor systems have calibration systems that are relatively difficult to use or can be calibrated to a poor performance, for example, calibrated to a worn nozzle without any indication of a problem.

SUMMARY OF THE INVENTION

To overcome the disadvantages described above and to provide a more advanced system for monitoring the operation of a fluid dispensing system, the present invention provides a method and apparatus for providing early warning indicators to the operator that adverse flow conditions are beginning to occur so that corrective action may be taken. The progression of those adverse flow conditions is monitored until they are corrected or until they reach a point that requires alarm indicators be generated, displayed and acted on. Therefore, the invention is particularly suited for detecting and following warning and alarm pressure conditions in fluid dispensers over periods of time and is especially useful in production applications having many fluid dispensers that are associated with one or more coating lines.

According to the principles of the present invention and in accordance with the described embodiments, a flow sensor, for example, a pressure transducer is connected to each of a plurality of fluid dispensers. Each of the pressure transducers is located between a flow restriction having a calibrated orifice and the flow control valve in the fluid dispenser and measures firing pressure during the gun ON time and static pressure during the gun OFF time. Each pressure transducer produces a firing pressure signal which represents a characteristic of the fluid flow in the dispenser. Each of the pressure transducers is connected to a microprocessor based monitor control remote from the fluid dispenser, and a data communications network provides the electrical communications between the plurality of the monitor controls and one or more operator controls located remote from the fluid dispensers.

Each of the monitor controls periodically samples a pressure input signal from the pressure transducer both during the time fluid is being dispensed and the period of time fluid is not being dispensed through the fluid dispenser. The monitor controls execute a process for periodically comparing the sampled static and firing fluid pressure values with a plurality of respective static and firing pressure reference values, or pressure limits. With the present invention, the static and firing pressures are defined in terms of a single pressure or a range of pressures considered to be acceptable or normal. Typically, the firing pressure is defined in terms of a range of desired, or acceptable pressures values, and the static pressure is defined in terms of an single desired, or acceptable pressure value. Warning pressure limits and alarm pressure limits are established above and below the acceptable firing pressure range, and alarm pressure limits are established above and below the acceptable static pressure value. Generally, warning error conditions exist when the firing pressure value is between a warning pressure limit and an alarm pressure limit, and alarm pressure conditions exist when a static or firing pressure exceeds or is outside the range of the alarm pressure limits. Pressure quality indicators representing operating conditions within the fluid dispensing system are produced in response to predetermined relationships between the measured fluid pressure values and various warning and alarm pressure limits.

The present invention provides for several unique strategies for producing warning and alarm error signals. and associated pressure quality indicators. The strategies may be used separately or in combination. First, for example, during sampling periods of sixty four pressure samples each, the average values of the measured static and firing pressures are compared to high and low static and firing pressure warning and alarm limits. Warning and alarm error codes are produced if the average pressure values exceed the warning and alarm limits, respectively. In a related strategy, the high and low warning pressure limits must be exceeded on a predetermined number of consecutive pressure samples before a warning error code is produced. This requires a stable pressure condition before a warning code is given. With a further strategy, for example, during a sampling period of sixty four pressure samples, warning and alarm static and firing pressure quality indicators are counted each time a sampled pressure value exceeds a respective pressure limit. Warning and alarm error codes are produced in response to counting predetermined numbers of the warning and alarm static and firing pressure indicators. For example, the monitor controls produce alarm and warning error codes as a function of a predetermined distribution, for example, an approximation of a Gaussian distribution, of the occurrences of the different pressure quality indicators.

The alarm error codes are established such that their occurrence is correlated to a high probability that the fluid is being improperly dispensed and is producing an unsatisfactory product; and therefore, their occurrence represents fluid flow conditions in the dispenser which require immediate action and correction. Alternatively, warning error codes are established such that their occurrence is correlated to a high probability that a fluid flow condition in the fluid dispenser is changing adversely, however, an acceptable product is still being produced. Therefore, warning error codes represent conditions of fluid flow through the dispenser which are outside a normal range but are not yet at a critical condition at which an alarm error code would be required. The method of analyzing the pressure signal of the present invention provides the advantage of supplying more information to an operator at a point in time at which potential problems may be anticipated and corrected before a condition occurs that requires the operation of a fluid dispenser to be stopped and taken out of service.

In addition, the monitor control measures the transition periods required for the fluid pressure value to change between the static and firing pressure values. Therefore, the invention has an advantage of monitoring the opening and closing of the valve in the fluid dispenser without the necessity of additional current and/or voltage sensors to monitor the valve operation.

In a further embodiment of the invention, one or more remotely located operator controls receives and stores data from the monitor controls associated with each fluid dispenser; and consequently, an operator can use the operator control(s) to remotely monitor the warning and alarm error codes associated with any of the fluid dispensers. The use of a remote operator control is facilitated by a data communications network which has the advantage of connecting the operator control(s) to all of the monitor controls with a minimum of wiring therebetween. Further, the data communications network has higher noise immunity, has greater flexibility with respect to various configurations of the fluid dispensers, the monitor controls and the operator control(s).

In addition, the operator control of the present invention may be used for diagnostic purposes to selectively display various conditions associated with the fluid dispenser that may result in a particular alarm or warning error code being generated by the monitor control.

The present invention further provides a method of calibrating the monitor controls by calculating a theoretical firing pressure as a function of nozzle size, the static pressure of the fluid being supplied, and the calibrated orifice plate being used. The theoretical firing pressure is compared to an average of measured firing pressures during several fluid dispensing cycles. The theoretical and average firing pressure values are compared to determine whether the fluid dispenser is set up and operating correctly. The calibration method of the present invention has the advantage of providing a more reliable operation of the monitor control.

The current invention also includes an attachment for mounting the transducer to the fluid dispenser which allows the transducer to be swiveled or rotated and locked in any desired position with respect to the longitudinal centerline of the fluid dispenser. The above construction provides the advantage of being able to position the pressure sensor such that it can be easily accessed and the wires thereto do not interfere with other system components.

The above embodiments of the present invention have additional advantages of improving performance, permitting adverse flow conditions to be corrected before they become critical thereby improving the efficiency of associated production lines with which the monitoring control is used. Reducing the amount of time such lines are shut down substantially reduces the cost associated therewith. These and other objects and advantages of the present inventions will become more readily apparent during the following detailed description, together with the drawings herein.

DETAILED DESCRIPTION OF THE INVENTION

Fluid Dispensing Gun

Figure 1:
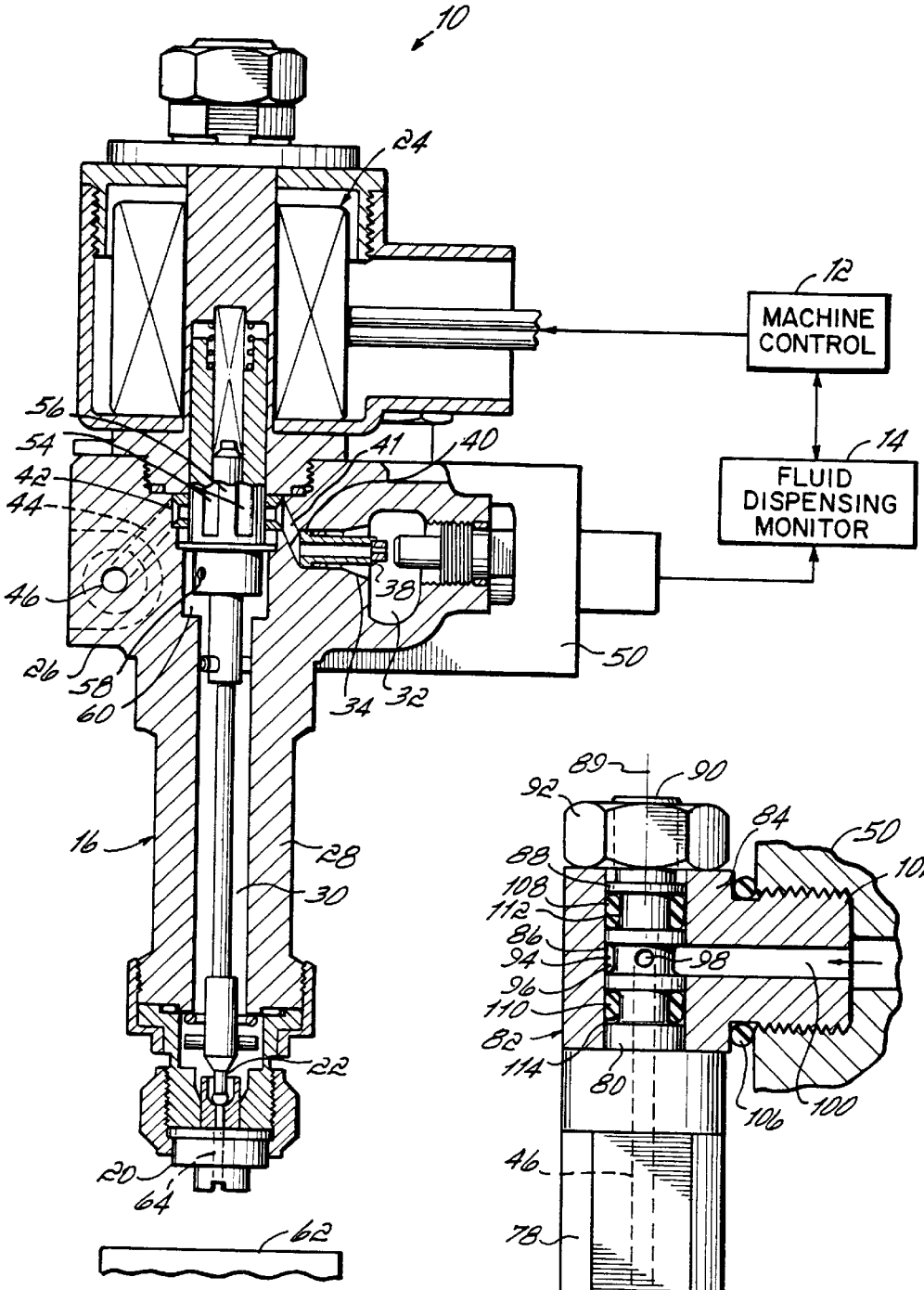
FIG. 1 is a cross-section view of a fluid dispensing gun utilized with the present invention.

FIG. 1 illustrates a known fluid dispensing gun 10, one or more of which may be used on coating lines to spray or dispense fluid on objects, such as cans, being conveyed past the guns. In the presently preferred embodiment, gun 10 is a A20A model gun manufactured by Nordson Corporation of Amherst, Ohio. Each fluid dispensing gun is operatively connected in a known manner to a machine control 12 and the fluid dispensing monitor 14 of the present invention. The machine control 12 is responsive to various process conditions for controlling the operation of the fluid dispensing gun. For purposes of this description, the machine control 12 refers collectively to one or more control units associated with the fluid dispensing gun, a source of pressurized fluid, a conveyor monitoring mechanism or other device which may provide input signals to or accept output signals from the fluid monitor 14. The fluid dispensing monitor 14 monitors a characteristic of fluid flow, for example, fluid pressure, within the gun 10 both during the times the machine control 12 turns the gun 10 ON and OFF. The fluid dispensing monitor 14 produces fluid flow condition signals, for example, warning and alarm signals representing abnormal static and firing pressures as measured within the dispensing gun which are displayed to an operator. In addition, the alarm signals are sent to a machine control 12 to turn the gun 10 OFF or effect another remedial action.

Generally, the fluid dispensing gun 10 is comprised of a body 16 through which fluid is supplied to a nozzle 20 at one end of the body 16. The opening and closing of valve 22 is controlled by a solenoid 24 mounted on an opposite end of the body 16. The body 16 comprises a ported body block 26 connected to a body extension 28. The body block 26 has a throughbore 30 which is counterbored and threadedly connected to the housing for the solenoid 24. The axial throughbore 30 is in fluid communication with and connected by internal passages to, the fluid inlet port passage 32 which is connected to a source of pressurized fluid 202 shown schematically in FIG. 3. The fluid inlet port passage 32 is connected to one end of a connecting passage 34 into which is mounted a calibrated orifice plate 38. The other end 40 of the connecting passage 34 is connected by an intermediate passage 41 to a first fluid flow chamber 42 which provide fluid communication between the other end 40 of the connecting passage 34 and a pressure take off fluid passage 44. The fluid passage 44 is connected to the transducer mounting passage 46 which extends through a swivel fitting 48 (FIG. 2) to which a sensor, for example, a pressure transducer 50 is mounted. The pressure transducer 50 includes a pressure sensor and a signal amplifier and produces a pressure signal that is less susceptible to noise, for example, pressure transmitter model LV commercially available from Sensotec of Columbus, Ohio.

Figure 2:
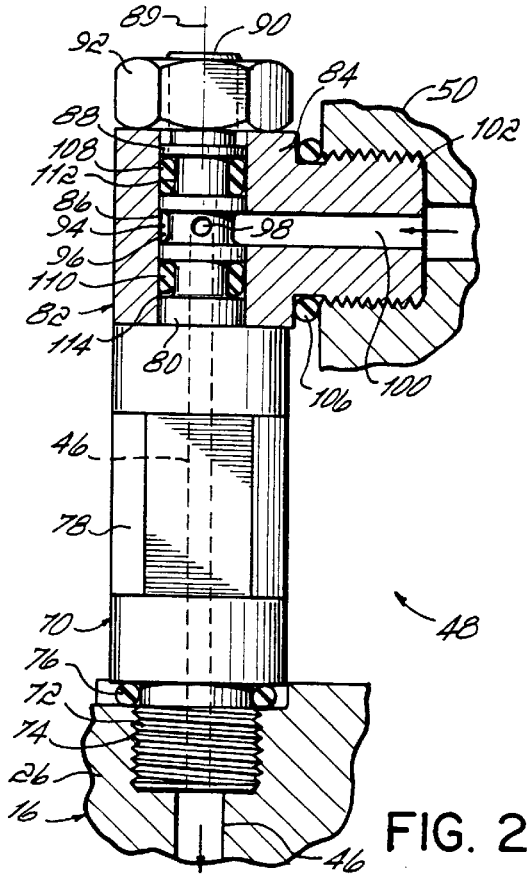
FIG. 2 is a partial cross-sectional bottom view of the components of the swivel mount for the pressure transducer.

Referring to FIG. 2, the swivel fitting 48 permits the pressure transducer 50 to be selectively located at different angular positions with respect to a longitudinal axis of the swivel fitting 48 so that the transducer may be easily installed without twisting its wires and keeping its wires free from interference with other equipment. The sensor mount fitting includes a stem 70 having a first threaded end 72 which engages a threaded hole 74 within the body 16. An O-ring 76 provides a fluid seal between the stem 70 and body 16. The stem 70 has a cylindrical body 78 extending along a major portion of the longitudinal length of the stem 70. A shaft 80 is rigidly connected to the cylindrical body 78 and has a diameter substantially less than the diameter of the cylindrical body 78. A swivel member 82 has a cylindrical body section 84 with a bore 86 centrally located within the cylindrical body section 84. The cylindrical bore 86 is sized to slidably mount on the circumferential surfaces of locating rings 88 on the shaft 80. Consequently, the swivel 82 is free to rotate with respect to the central longitudinal axis 89 of the stem 70. The shaft 80 has a threaded outer end 90 to which a locking nut 92 is threadedly engaged. As the locking nut 92 is tightened, it squeezes the swivel 82 between itself and the stem 70 thereby locking the swivel in a selectable angular position relative to the longitudinal axis 89 of the stem 70.

A fluid chamber 94 is formed between the internal bore 86 and an annular groove 96 contiguous with one end of a radial passage 98. The other end of the radial passage 98 intersects and is contiguous with one end the fluid passage 46 which extends centrally through the shaft 90 and cylindrical body 78 of stem 70. The fluid chamber 94 is also contiguous with a swivel fluid passage 100 extending centrally within a mounting member 102 on the swivel 82. The mounting member 102 extends radially and in a generally perpendicular direction with respect to the stem 70 and its central axis 89. The mounting member 102 includes threads that engage mating threads on the transducer element 50; and the O-ring 106 provides a fluid tight seal between the transducer 50 and the swivel 82. The O-rings 108, 110 located in annular grooves 112, 114 on the shaft 80 provide a fluid tight seal between the shaft 80 and the internal bore 86 of the swivel 82.

Referring to FIG. 1, in response to various input signals, the machine control 12 provides ON and OFF signals to the solenoid 24 which respectively opens and closes the valve 22 thereby turning the fluid dispensing gun 10 ON and OFF. When the gun is turned ON, fluid flows through the inlet port passage 32 and through the calibrated orifice plate 38. If the flow related parameters, for example, the static pressure, the condition of the control valve, the gun orifice size, etc. are within specification, the calibrated orifice plate provides a small pressure drop there across, preferably at least 50 pounds per square inch ("psi"). Therefore, the pressure in the first fluid flow chamber 42 which is measured by the pressure transducer 50 is equal to the static supply or regulated static pressure less the pressure drop across the calibrated orifice; and that measured pressure will change as a function of changes in the flow related parameters. Fluid then passes through openings 54 in the armature 56 of solenoid valve 24. The openings 54 are connected by internal passages with armature ports 58 which open into a second fluid flow chamber 60. Consequently, fluid flowing through the calibrated orifice plate 38 flows through the first chamber 42, through the armature 56 via openings 54 and ports 58 and into a second chamber 60. Thereafter, the fluid is conducted through the throughbore 30, through the valve 22 and out the nozzle 20 to coat an object, for example, a can, 62 proximate the nozzle 20.

When the solenoid 24 is energized which opens the flow control valve 22, thereby turning the gun 10 ON, the calibrated orifice plate 38 produces a pressure drop within the flow chambers 42, 60 of the fluid dispensing gun 10. That pressure drop is easier to measure than trying to measure variations in the parameters themselves. When the gun is turned ON, the measured pressure within the first fluid flow chamber 42 is, for purposes of this application, referred to as the "firing pressure" and is equal to the set static pressure less the firing pressure drop across the orifice plate. Under normal flow conditions and given a static pressure of, for example, 800 psi, the calibrated orifice will produce a firing pressure drop of at least 50 psi; and therefore, a normal firing pressure will be approximately 750 psi.

When the flow control valve 22 is opened, if the nozzle 20 is clogged and flow through the nozzle 20 is diminished, the firing pressure will be higher than normal and the pressure drop will be less. This higher firing pressure value is detected by the fluid dispensing monitor 14. Similarly, as the nozzle 20 becomes worn and the fluid flow therethrough increases, the firing pressure decreases; and the pressure drop across the calibrated orifice increases. The reduced firing pressure is detected by the fluid dispensing monitor 14. In addition, when the gun 10 is turned OFF, the pressure within the first chamber 42 is expected to be approximately equal to the static pressure of the fluid being supplied to the gun 10. Variations from expected pressures at the output of the calibrated orifice plate are detected by the transducer 50 and are analyzed by the fluid dispensing monitor 14. The fluid dispensing monitor 14 provides fluid flow condition signals and data as a function of the detected changes in the fluid pressure in the first chamber 42 which reflect variations in the fluid flow conditions through the fluid dispensing gun 10.

Fluid Monitor System Control

Figure 3:
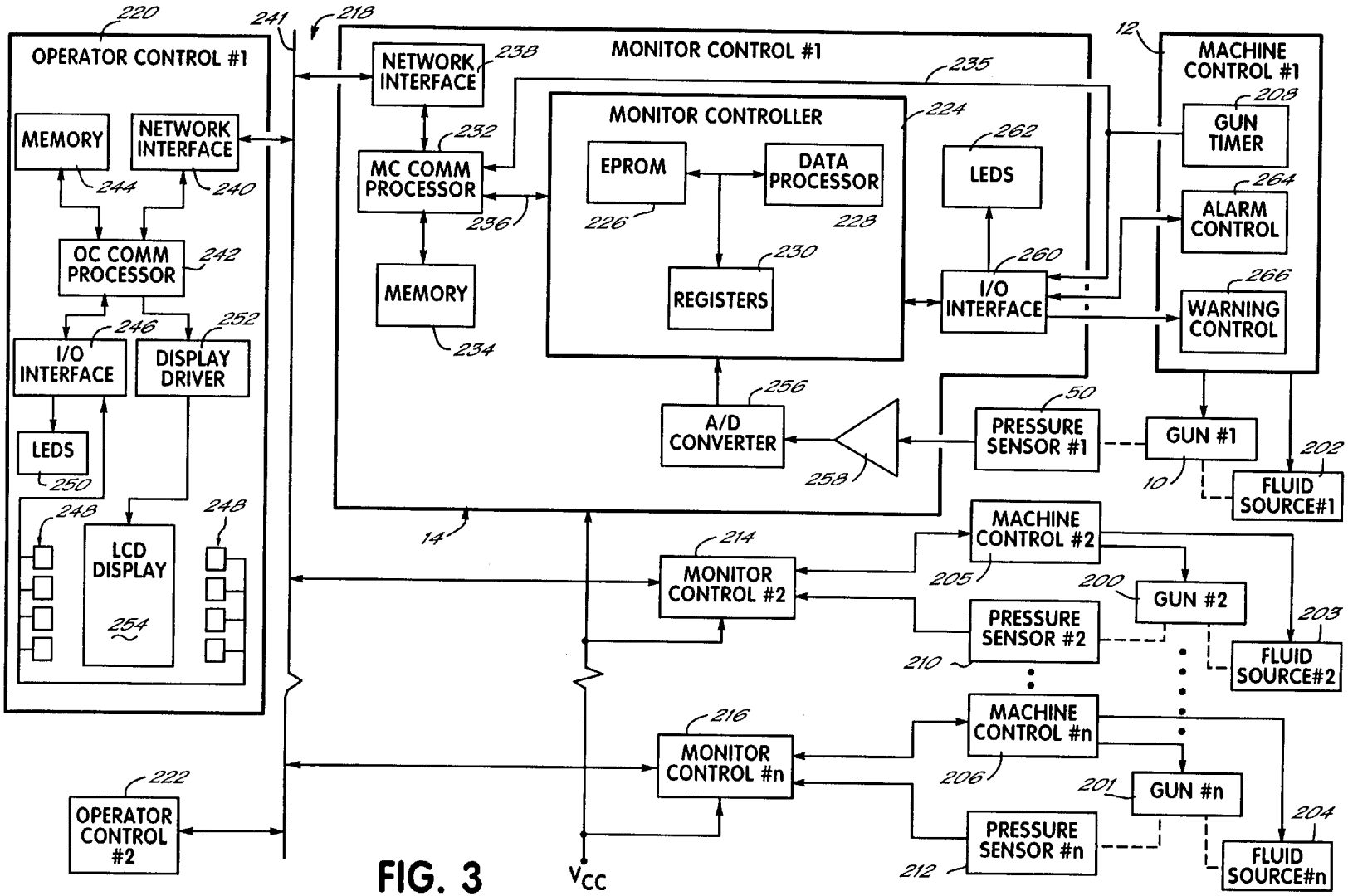
FIG. 3 is a schematic block diagram of the monitor control and associated operator control of the present invention which is operatively connected to the fluid dispensing gun and its associated control.

FIG. 3 is a schematic block diagram of a fluid dispensing system utilizing the present invention. Any number of fluid dispensing guns 10, 200, 201 are connected to and receive pressurized fluid from fluid sources 202, 203, 204. Each gun may have an individual fluid source or may be separately regulated from a common fluid source. Within a production coating system, for example, the guns may be located adjacent to a can conveyor and utilized to spray a coating on the interior of the cans as they move past the guns. In addition, proximity sensors (not shown) associated with each of the guns are used to detect the presence of cans prior to the cans encountering the respective guns. The proximity sensors associated with the guns 10, 200, 201 are part of their respective machine controls 12, 205, 206. Each of the machine controls includes a timing device such as the gun timer 208 shown in association with machine control 12. In response to signals from the sensors indicating the presence of a can to be sprayed, the gun timers provide timing signals to the guns 10, 200, 201 to turn the guns ON thereby dispensing fluid therefrom and coating the cans. After a predetermined period of time, the gun timers within the machine controls 12, 205, 206 change the state of the timing signals to turn the guns 10, 200, 201 OFF. During the times the guns are turned ON and OFF, sensors 50, 210, 212, such as pressure transducers, are continuously measuring the pressure between the calibrated orifice plate and the nozzle in each of the respective guns, 10, 200, 201. Monitor controls 14, 214, 216 are associated with but located remotely from their respective guns 10, 200, 201. For example, each of the monitor controls may be located anywhere from several inches to 100 feet away from its respective pressure transducer and dispensing gun. The monitor controls are further connected to a communications network 218 and transmit and receive data from one or more operator controls 220, 222. The operator control provides a central point at which monitored data from all of the monitor controls may be displayed to the operator; and the operator control accepts input data from the operator which may be transmitted to any of the monitor controls. The operator control and any or all of the monitor controls may be separated by a distance of from several inches to more than 5000 feet. Therefore, in any particular system, there are many fluid dispensing guns and an equal number of associated monitor controls combined in a configuration of processing or production lines; but there are comparatively few operator controls which monitor the fluid flow conditions in the guns. Each operator control is capable of remotely monitoring flow conditions in all of the guns, and the operator controls may be located anywhere, for example, at one or more of the guns, at one or more processing control stations associated with respective processing lines, in a different room or in a different facility such as a process control or service center. A typical can coating plant may have two or three can coating lines with five to seven coating guns on each line.

All of the monitor controls are identical in construction and therefore only monitor control 14 will be described in detail. The pressure monitoring process is executed by a monitor controller 224 which is implemented by a microcontroller commercially available as PIC16C5X from Microchip Technologies, Inc. of Chandler, Ariz. The monitor controller 224 operates with a memory device, for example, an EPROM, 226 for storing programmed instructions controlling the operation of a data processor 228. The data processor responds to the program instructions within the EPROM 226 to implement various timers and counters using registers 230. In addition, the registers 230 provide temporary storage for data being transferred between the monitor controller 224 and the machine control 12. Operating programs for the monitor controller 224 are written in a RISC assembly language associated with the microcontroller 224 and stored in the EPROM 226. A MC communication processor 232 communicates with the monitor controller 224 over a bi-directional link 236 which has an architecture similar to an RS-232 interface. The MC communication processor 232 may be implemented using a "NEURON CHIP" processor commercially available from Motorola, of Phoenix, Ariz. Development tools and software for the "NEURON CHIP" processor are commercially available from Echelon Corporation of Los Gatos, Calif.

The MC Communication Processor 232 and OC Communication Processor 242 exchange data in accordance with a data communications cycle and protocol determined by the "NEURON CHIP" processor. Some data, for example, the number of cans coated and the current measured pressure is transferred from the MC communications processor 232 to the OC communications processor 242 during a continuously repeated data transfer cycle that is executed approximately every 500 milliseconds. In addition, either of the communications processors 232, 242 can initiate an asynchronous data transfer cycle with the other processor in response to an operator input or other process condition. For example, at different times determined by the operator or the process, the MC Communication Processor 232 transmits data to the OC Communication Processor 242 which may include, for example, power ON configuration data, installation data relating to the particular gun associated with the monitor control, newly generated error codes, newly calculated pressure limit information generated during the execution of a calibration mode, the current firing and static pressures as determined by the monitor control. Further, at other times determined by the operator or the process, the OC Communication Processor 242 transmits data to the MC Communication Processor 232 which may include, for example, the current time and date, requests for data, such as, diagnostic error code information resulting from an operator actuating pushbuttons 248, etc.

The MC communication processor includes its own EPROM and RAM and also communicates with external memory 234. In addition, the MC communication processor 232 communicates with operator control 220 over network 218 which has an RS-485 architecture. The network 218 includes a transmitter receiver network interface 238 associated with the monitor control 14 and a second transmitter receiver network interface 240 located with the operator control 220. The network interfaces 238, 240 are interconnected by a network media, or link, 241 such as four wire cable.

All of the operator controls are identical in construction to the operator control 220. Within the operator control 220, an OC communication processor 242 identical to MC communication processor 232 is connected to an external memory 244. The OC communication processor 242 is connected to an input/output interface 246 which in turn is connected to pushbuttons 248 and LED displays 250. The communication processor 242 is also connected to a display driver 252 which operably communicates with a display 254 such as a liquid crystal display ("LCD") or other display mechanism. The operator may use the pushbuttons 248 on any of the operator controls 220, 222 to enter input data signals representing configuration data and set up parameters for each of the monitor controls 14, 214, 216.

Data entered at the operator control 220 relating to a particular monitor control is immediately transferred to that monitor control, but the data is stored in the memory associated with the operator control. Messages displayed on the LCD display 254 originate from the monitor control 14. Therefore, the OC communications processor within the operator control 220 simply communicates with either the network interface 240, the I/0 interface 246 or the display driver 252 and does not execute any programs that are necessary for the monitor control 14 to perform its functions. Therefore, after the operator control is used to setup the initial operating parameters in the monitor controls, the monitor controls operate independently; and the operator controls may be disconnected from the network 218. However, the operator controls have a nonvolatile memory, for example, memory with a battery back-up, in which the configuration and set-up parameters are stored for each of the guns. Therefore, in the event that a monitor control loses power or must be replaced, the operator control may be used to quickly reenter the configuration and setup parameters.

The MC communications processor 232 functions as a communication link between the network interface 238 and the monitor controller 224. In addition, the MC communications processor 232 stores and executes programs which are used to calibrate the monitor processor. The MC communications processor 232 also transmits diagnostic data stored in memory 234 in response to requests for such data from the operator control 220. Further, the MC communications processor is responsive to the gun timing signal on line 235 from the gun timer 208. The processor 232 counts the number of occurrences of the gun timing signal ON time produced by the gun timer 208 which in an intermittent coating system will correspond to the total number of objects or cans coated by the fluid dispensing gun 10. An intermittent coating system turns the gun ON and OFF with each can coated and is distinguished from a continuous coating system in which the gun is maintained ON continuously while objects to be coated are conveyed past the gun. The processor 232 transfers the current total number ON times counted, that is, the current can count, to the OC communications processor 242 with each regular data transfer cycle between the processors 232,242. The current can count for all of the guns 10,200,201 in the system is stored in the memory 244 and is displayed by the operator control as part of the data associated with each gun. In addition, each time the operator uses pushbuttons 248 to reset the stored can count for a particular gun to zero, the processor 242 stores in the memory 244, for subsequent display to the operator, the date and time that the command to reset the can count for that particular gun was given by the operator. In addition, a history of times and dates of a predetermined number can count resets is stored in memory 234 by processor 232.

The monitor controller 224 samples the fluid pressure measured by the sensor 50 by periodically reading the A/D converter 256 which is connected to the sensor 50 through a signal conditioning circuit 258. The monitor controller 224 executes programs which analyze the measured pressure signals and produce fluid flow condition signals representing alarm and warning error codes to an I/O interface 260. The I/O interface generates alarm and warning signals to illuminate the appropriate LEDs 262 and operate respective alarm and warning control circuits 264, 266 within the machine control 12. Typically, the alarm warning control circuit terminates operation of the dispensing gun 10. That may be accomplished by turning OFF the gun timer 208, terminating the supply of fluid from the fluid source, or through a combination of operations. The warning signal may be used to adjust the quantity of fluid flow or static pressure of the fluid from the fluid source 202. In addition, fluid flow condition signals produced by the monitor controller represent fluid flow condition data, for example, alarm and warning error codes, other flow condition data and associated message data, all of which is sent to the operator control 220. Within the operator control, the data is effective to illuminate the appropriate LEDs 250 and display messages on the display 254.

Fluid Monitor Operation

Figure 4:
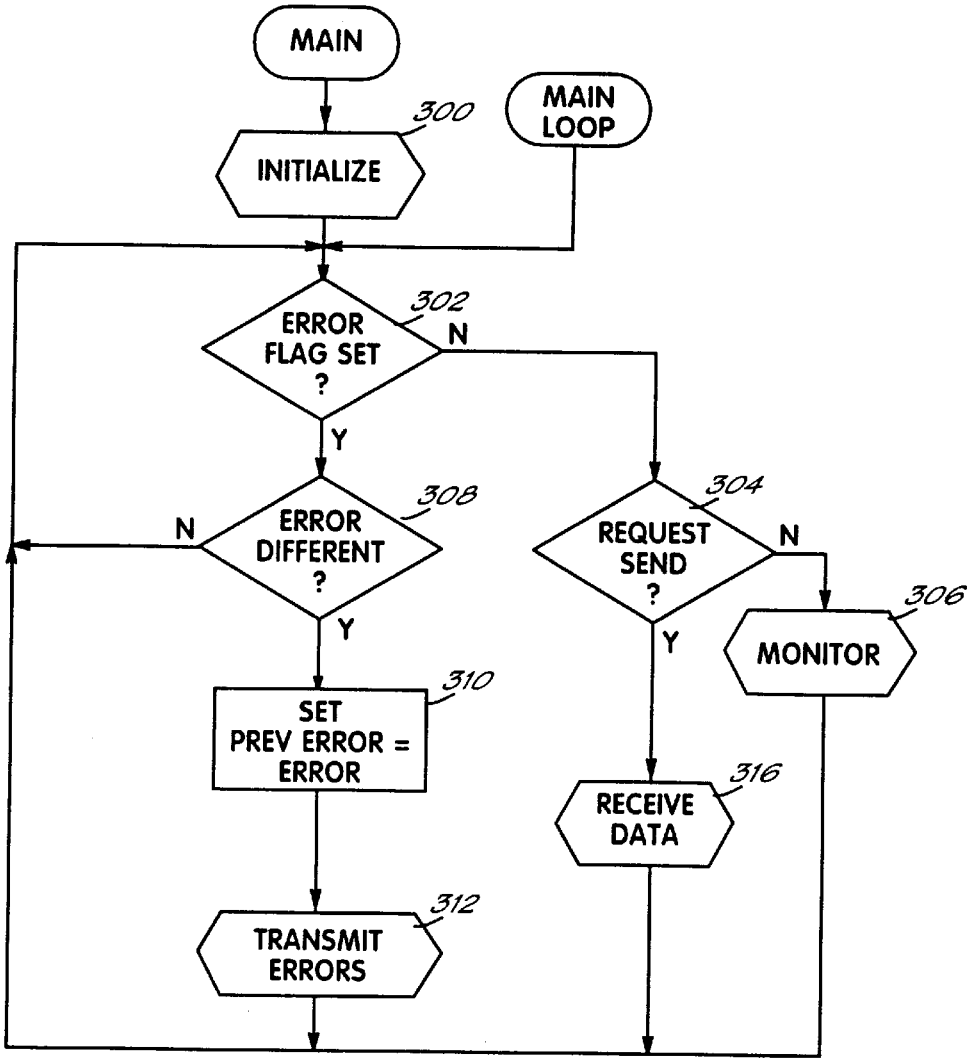
FIG. 4 is a flow chart of the main routine executed by the data processor within the monitor control.

FIGS. 4, 6–12 illustrate the various programs, that is, routines and subroutines, that are stored in the memory, for example, the EPROM 226, of the monitor controller 224 within the monitor control 14. Upon power being applied to the monitor control, the main routine of FIG. 4 is initiated and runs continuously while power is applied to the monitor control. The routine of FIG. 4 includes a watchdog timer which checks for an iteration of the main routine each 0.5 seconds. If the routine is inadvertently stopped or otherwise hangs up, the watchdog timer times out and provides an error message to the operator. The routine executes at 300 an initialization subroutine to perform the initialization and set up that is typically required to establish default settings within the monitor control and monitor controller when power is initially applied. The main routine has three basic subroutines which represent three operating modes; a first, transmit mode transmits error codes and associated messages from the monitor control to the operator control. The second, receive mode receives data transmitted from the operator control to the monitor control. The third, monitor mode detects a characteristic of fluid flow, for example, pressure, through the dispenser to monitor fluid flow conditions. The three different operating modes are prioritized; and within the process of FIG. 4, the order of priority is the transmit mode, the receive mode and the monitor mode; however, other orders of priority may be used.

Figure 5:
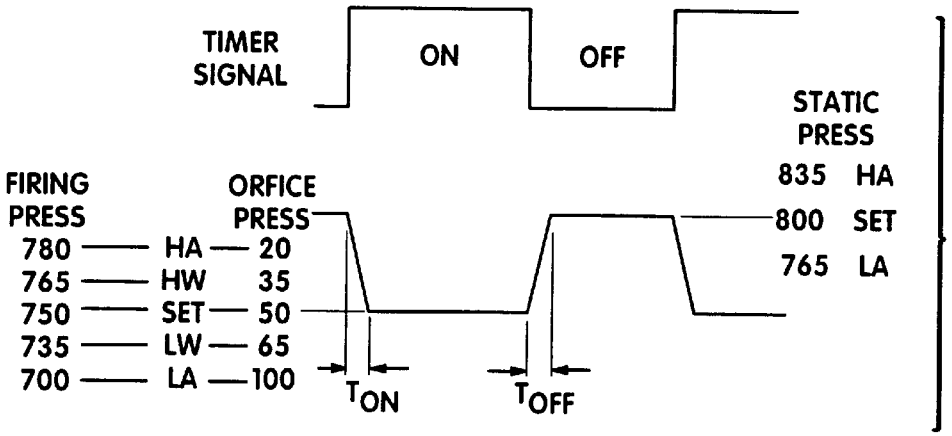
FIG. 5 is a timing diagram illustrating the relationship of the fluid dispenser timing signal to the pressure within the fluid dispenser.

In the absence of error codes as detected at 302, and if there is no data to be received at 304, the monitor subroutine 306 is executed. The monitor subroutine 306 detects fluid pressure in the gun to generate various error codes and/or messages. Referring to FIG. 5, during the monitor subroutine, pressure between the calibrated orifice and the nozzle is sampled during the ON and OFF times over successive sampling periods comprised of a predetermined number, for example, 64 pressure samples. Assume that the desired, or acceptable static pressure, that is, the pressure from the fluid supply, either regulated or unregulated, when the flow control valve is closed and the gun is turned OFF, is 800 psi, and high and low static pressure alarm limits are set at 835 psi and 765 psi, respectively. The static pressure is sampled during the gun OFF time, and high and low static pressure quality indicators are produced as will be subsequently described as a function of comparing the measured static pressure to the high and low static alarm limits. The monitor subroutine then counts the occurrences of the various static pressure quality indicators during the sampling period and produces fluid flow condition signals as a function of comparing the frequencies of occurrence of the static pressure quality indicators to predetermined reference values. Fluid flow condition data is also created by measuring the average static pressure during the sampling period and comparing it to a reference static pressure value.

With reference to FIG. 5, during the gun ON time, assume that the normal firing pressure drop across the calibrated orifice is 50 psi and the static pressure is 800 psi. Therefore the normal, or set firing pressure, that is, the pressure drop across the nozzle, will be 750 psi. High alarm ("HA"), high warning ("HW"), low warning ("LW") and low alarm ("LA") pressure limits, or pressure reference values, for the firing pressure may be set at 780 psi, 765 psi, 735 psi and 700 psi, respectively. Those limits will result in respective pressure drops across the calibrated orifice of 20 psi, 35 psi, 65 psi and 100 psi. As will subsequently be explained, during an ON time sampling period, the monitor subroutine samples the fluid pressure over continuously occurring sample periods. Each sample period includes sixty four samples, and the monitor control produces various firing pressure quality indicators as a function of comparing sampled fluid pressures to the firing pressure limits. For example, different types of firing pressure quality indicators are produced if the sampled firing pressure is either, in excess of the alarm limits, or between the warning and alarm limits, or between the warning limits. Each occurrence of the same type of firing pressure quality indicator during the sampling period is counted, and the frequency of occurrence of the low alarm, low warring, normal flow, high warning and high alarm firing pressure quality indicators are used to produce warning and alarm error codes to the operator. Error codes are also produced as a function of comparing the average pressure value measured over the sampling period to the various alarm and warning pressure limits. Some fluid flow condition signals represent alarm conditions which, by design, require immediate attention and are operative to provide immediate remedial action. Other fluid flow condition signals represent warning conditions which should be monitored but no immediate remedial action is required. The above pressure sampling process runs continuously during the gun ON and OFF times regardless of the duration of the ON and OFF times.

Referring to FIG. 4, upon any fluid flow condition signal being generated, during the next iteration through the main routine, the transmit mode is entered at 302 if any error codes have been produced, or error flags have been set during the previous iteration. If the same error was previously set, as detected at 308, there is no value in taking time to transmit the same information to the operator control. Therefore, no further action is taken. If, however, the error is different at 308, the value of the previous error is set equal to the current error at 310; and the new error codes are transmitted at 312 from their storage locations in the registers 230 of the monitor controller 224 across the data link 236 to the MC communication processor 232. Thereafter, the MC communication processor 232 transfers the error codes and messages to the network interface 238 which in turn transmits the data to the operator control 220 for display to the operator.

If the operator uses the pushbuttons 248 on the operator control 220 to provide different operating parameters for the monitor control, those parameters are transmitted from the operator control 220 to the MC communications processor 232. The MC communication processor 232 temporarily stores the data and sets a request send flag across the link 236. During the next iteration through the main routine of FIG. 4, if no error flags are set at 302, and the request send flag has been set at 304; a receive data subroutine is executed at 316 which is effective to transfer the operator entered data from the MC communication processor 232 to the monitor controller 224. If no error flags have been set at 302, and no request send flag has been set at 304, the system enters the monitor subroutine 306.

Figure 6:
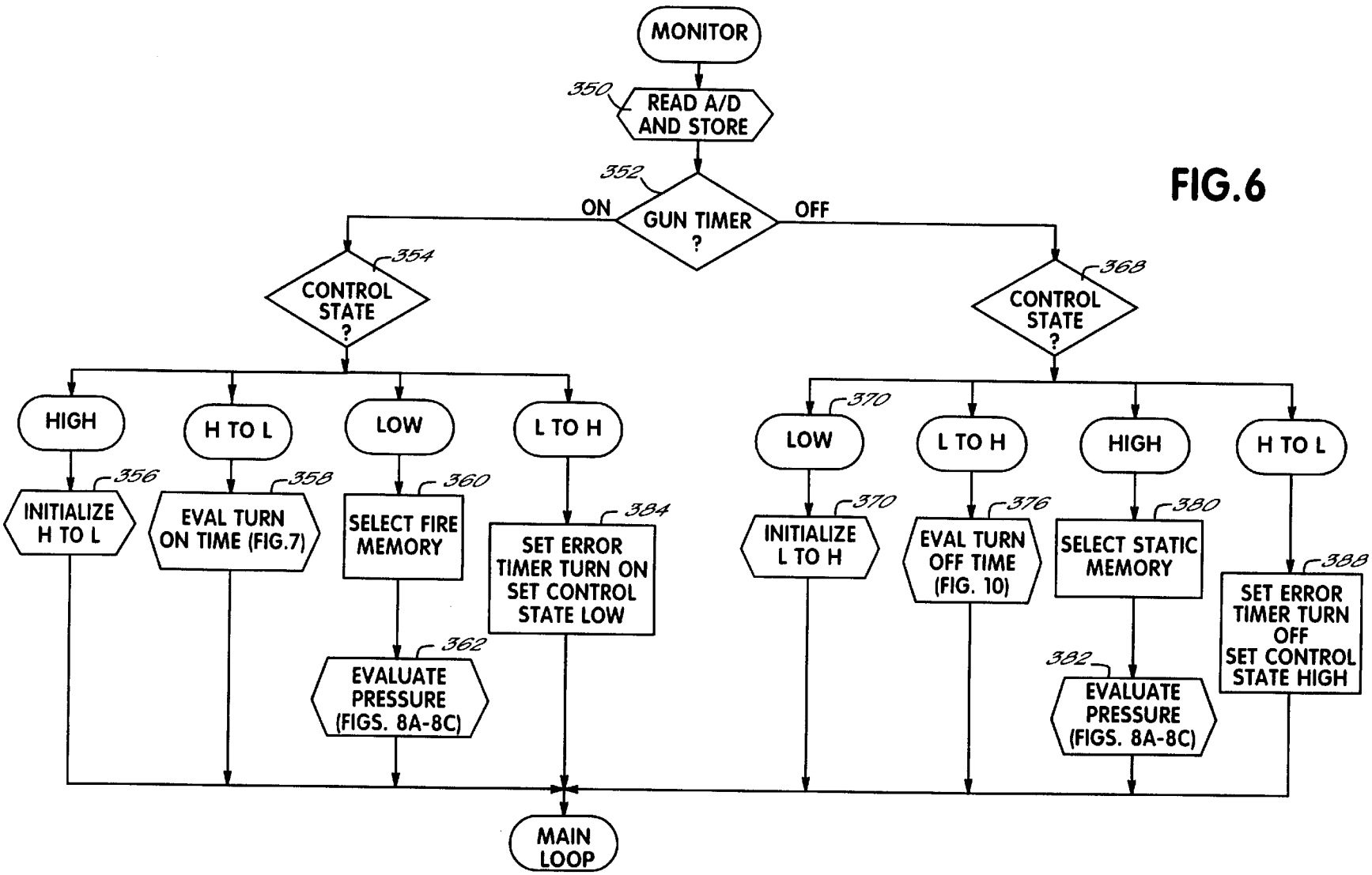
FIG. 6 is a flow chart of the monitor subroutine within the main routine of FIG. 4.

FIG. 6 illustrates the general steps of the monitor subroutine 306. First an A/D subroutine is executed at 350 to read the analog to digital ("A/D") converter 256 of FIG. 3 and stores a digital value of pressure in the monitor controller 224. As is well known and therefore not shown in FIG. 6, the A/D subroutine 350 may include tests to determine whether the A/D converter 256 is operating properly; and if not, an A/D read error may be generated. Referring to FIG. 5, when the gun timer turns ON, the pressure is at its regulated static, or base, value, and it takes a finite time, $T_{ON}$, for the valve 22 in the fluid dispensing gun 10 to open and the pressure to drop to the firing pressure. The monitor subroutine measures the time required to open the valve 22. Referring to FIG. 6, the monitor subroutine determines at 352 that the gun timer is ON. Assume that the static supply pressure has been properly set to, for example, 800 psi, and that the pressure regulator is operating properly. A HIGH control state will have been previously set as a final operation at the end of the prior gun OFF time. The HIGH control state associated with the gun ON condition is detected at 354, and an initialize H TO L subroutine is executed at 356 to measure the HIGH-to-LOW ("H TO L") transition of the pressure signal, that is, the turn ON time of the gun. During that subroutine, the HIGH control state is reset, and the H TO L control state is set. In addition, a pressure sample counter is reset as well as other counters and timers associated with the measurement of the H TO L transition; and the pressure state is set to FIRE.

The monitor control is now set to measure the time required for the H TO L transition, that is, the time required for the valve 22 to move from its closed position to its open position, thereby causing the pressure to change from the static pressure to the firing pressure. After executing the H TO L subroutine, the process returns to the main routine illustrated in FIG. 4. If there is no error flag and no request send flag, the monitor subroutine 306 is again executed; and referring to FIG. 6, the process again samples the input signal from the pressure transducer 50 at 350. The gun timer is still ON, and the H TO L control state is detected at 354 which causes an evaluate turn ON time subroutine to be executed at 358.

Figure 7:
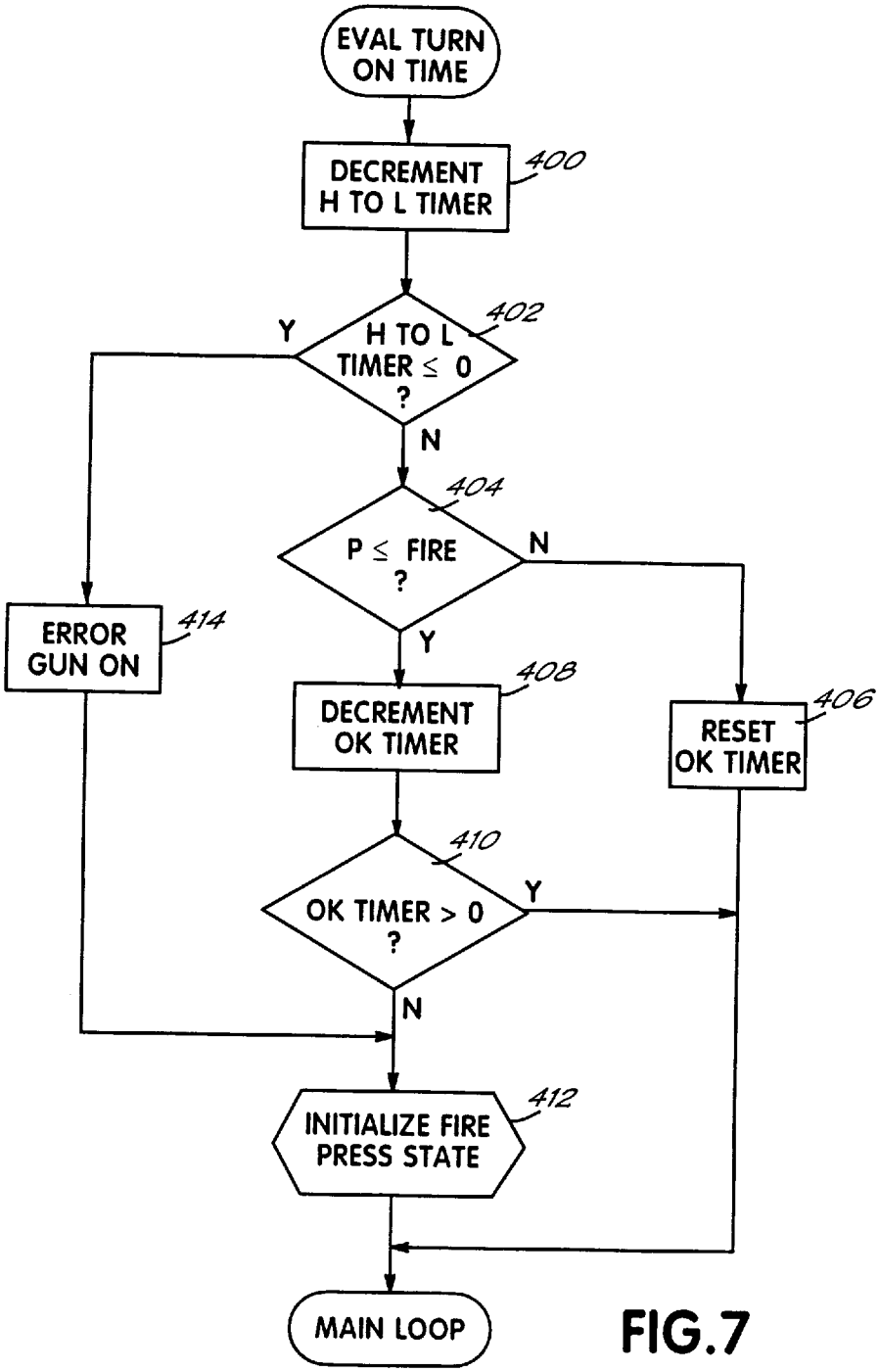
FIG. 7 is a flow chart illustrating the evaluate turn ON time subroutine called in the monitor subroutine of FIG. 6.

FIG. 7 illustrates the evaluate turn on time subroutine which measures the H TO L transition time. The H TO L timer was reset, that is, initialized, at 356 of FIG. 6 to count a time period within which the pressure transition is expected to occur, for example, 25 milliseconds; and the H TO L timer is now decremented by one increment at 400. Therefore, the H TO L timer requires that an acceptable pressure transition be detected within 25 milliseconds, otherwise a turn ON time, or, a gun ON, error code will be set. If the H TO L timer is not at its zero state at 402, the pressure read from the A/D converter (256 of FIG. 3 at step 350 of FIG. 6) is compared at 404 to a reference pressure value representing an acceptable value of firing pressure, that is, the firing pressure high warning limit, for example, 765 psi. As long as the pressure is greater than that acceptable value, an OK timer is reset at 406. During subsequent iterations, when the firing pressure becomes equal to or less than the acceptable value, the OK timer is decremented at 408 one increment. If the OK timer is greater than zero at 410, the monitor subroutine 306 is again executed to sample another value of the input signal from the pressure transducer 50. With each sample, the H TO L timer is decremented at 400; the magnitude of the pressure is tested at 404 against the acceptable firing pressure value; and if the pressure is acceptable, the OK timer is decremented at 408.

The OK timer provides a predetermined time delay or filter which requires that the pressure value stabilize before the pressure transition is considered acceptable. It has been observed that immediately after reaching an acceptable firing pressure value, the pressure experiences an additional pressure drop and is unstable for approximately five milliseconds. The OK timer, which is reset to five milliseconds screens the system from processing the unstable pressure values during that time. If, over consecutive iterations, the sampled pressure values maintain the acceptable pressure value for the 5 millisecond interval, the OK timer reaches a zero state; and an initialize firing pressure state subroutine is executed at 412. That subroutine resets, or deactivates, the H TO L control state, sets, or activates, the LOW control state, resets the H TO L and OK timers and clears various counters within the monitor controller. If the H TO L timer reaches a zero state prior to the OK timer counting to a zero state, which could happen if, for example, the solenoid is defective and does not properly operate the flow control valve, a gun ON error code is set at 414. During a subsequent iteration through the main routine, that error code is transmitted to the operator control for display to the operator.

Figure 8A:
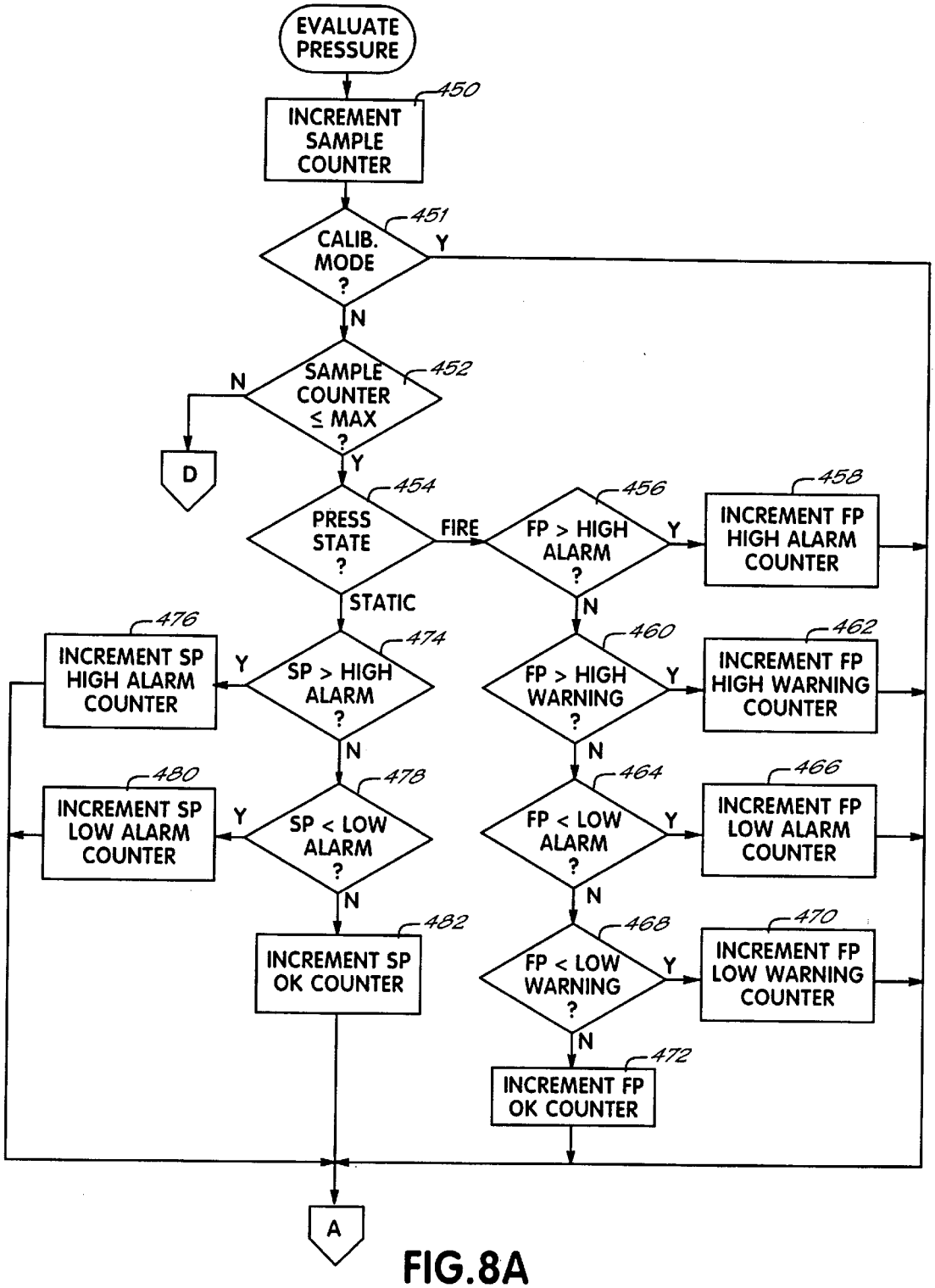
FIG. 8A, 8B, and 8C illustrate the evaluate pressure subroutine executed within the monitor subroutine of FIG. 6.
Figure 8B:
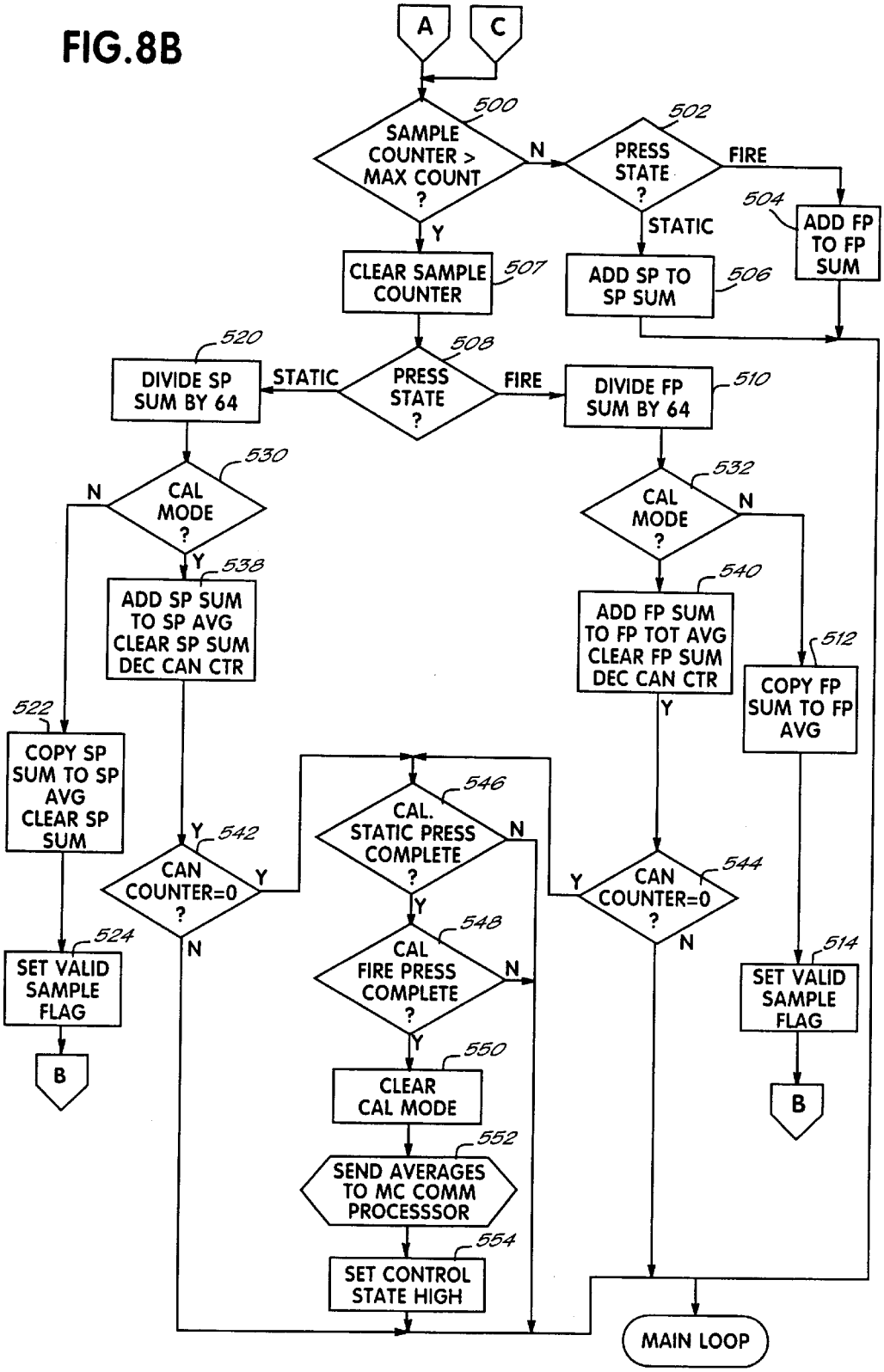
Figure 8C:
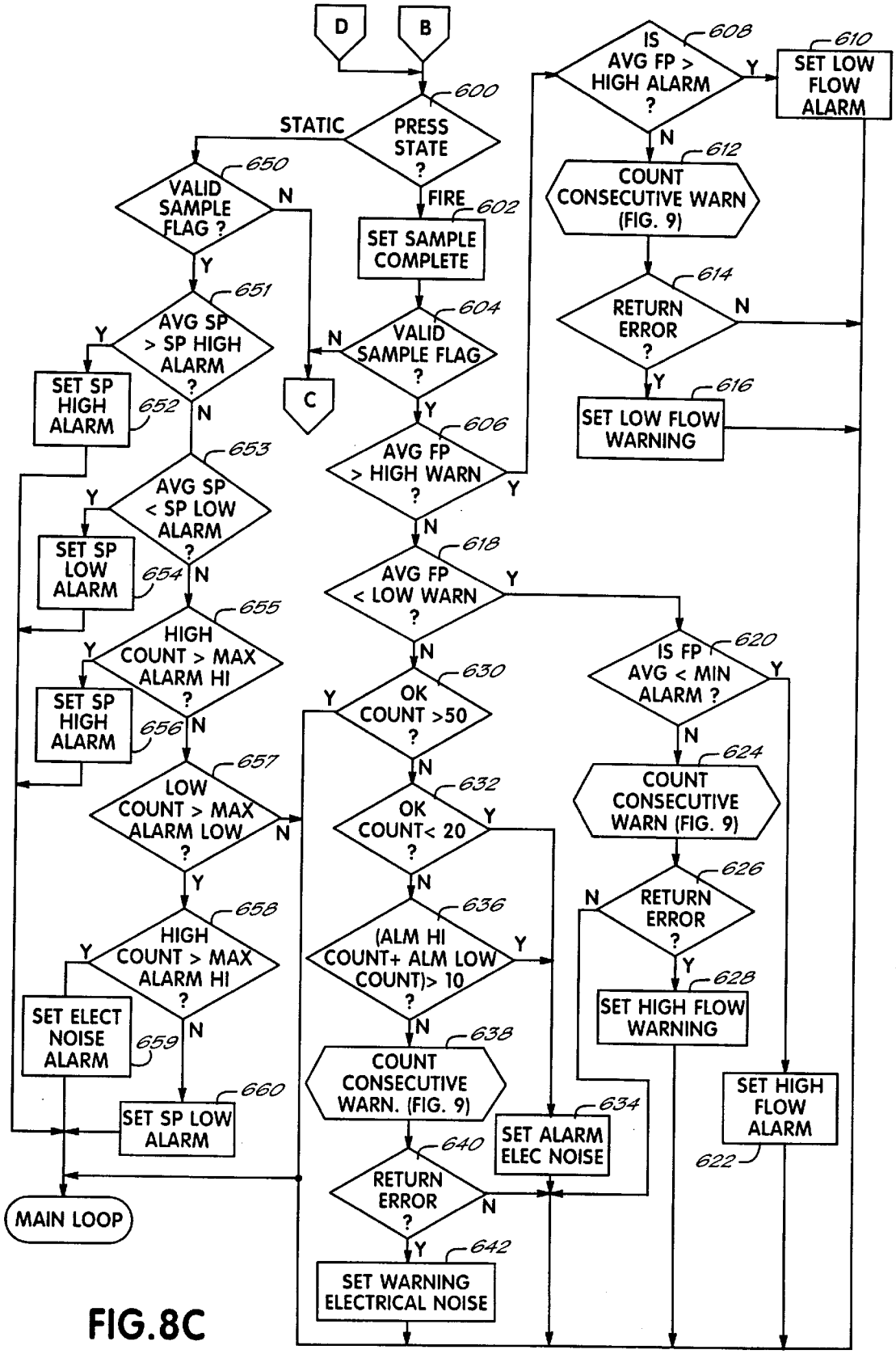

During the next iteration through the main routine of FIG. 4 and the monitor subroutine of FIG. 6, the LOW control state is detected at 354; and the memory locations within the monitor controller 224 are read to obtain the data required to evaluate the firing pressure. Thereafter, an evaluate pressure subroutine illustrated in FIGS. 8A, 8B, 8C is executed at 362. The pressure is evaluated by analyzing 64 samples of the pressure in the dispensing gun during a sampling period, and therefore, the evaluate pressure subroutine of FIGS. 8A–8C is iterated 64 times to determine whether the sampled pressure is acceptable, in a warning condition or in an alarm condition. Referring to FIG. 8A, the first step of the evaluate pressure subroutine is to increment a sample counter at 450 which keeps track of the number of pressure samples taken during a sampling period. Next, if the calibration mode which will be described later is not detected at 451, the sample counter is less than or equal to its maximum count of 64, and the firing pressure state is detected at 454, the measured firing pressure value "FP" is compared at 456 to a predetermined firing pressure high alarm limit, for example, 780 psi. If the sampled, firing pressure value is greater than the high alarm pressure limit, a firing pressure high alarm counter is incremented at 458. That counter tracks the occurrence of a pressure quality indicator representing a firing pressure greater than the firing pressure high alarm limit. If the firing pressure is less than the high alarm limit at 456, but is greater than a firing pressure high warning pressure limit at 460, for example, 765 psi, a firing pressure high warning counter is incremented at 462. That counter keeps track of the number of firing pressure high warning quality indicators which occur during the sampling period. If the measured firing pressure value is less than the low alarm pressure limit at 464, a firing pressure low alarm counter is incremented at 466 which counts the number of firing pressure low alarm quality indicators. If the sampled, firing pressure value is not less than the low alarm pressure limit at 464, but is less than low warning pressure limit at 468, for example, 735 psi, a firing pressure low warning pressure counter is incremented at 470 to track a pressure quality indicator representing a firing pressure less than the low warning limit. If the sampled, firing pressure value is between the low and the high warning pressure limits, an acceptable pressure quality indicator is counted by incrementing an OK counter at 472. The OK counter counts the number of pressure samples that are within acceptable pressure limits. Thereafter, referring to FIG. 8B, after passing through steps 500 and 502, the sampled, firing pressure value is added at 504 to a register containing an accumulated sum of firing pressure values. Consequently, the firing pressure sum register accumulates the total value of all firing pressures sampled during a particular sampling period; and that sum is subsequently used to calculate an average firing pressure value. At this point, the evaluate pressure and monitor subroutines end; and the process returns to the main routine of FIG. 4.

The process of FIGS. 8A and 8B heretofore described is iterated with each successive sampled firing pressure value until the sampling period ends, that is, when the sample counter has exceeded its maximum count of 64 at 452 of FIG. 8A. Over the sampling period of 64 pressure samples, the counters 458, 466 contain the number of pressure sample values that exceed the firing pressure high and low alarm limits, respectively. Similarly, counters 462, 470 contain the number of pressure sample values that do not exceed the high or low alarm limits but do exceed the high and low warning limits; and counter 472 counts the number of firing pressure samples that are acceptable. The sum in each counter represents a different firing pressure quality indicator, and the sums in the counters 458, 462, 466, 470 also represent a frequency distribution of those quality indicators over the sampling period. Those pressure variations generally occur because parameters affecting flow are changing; and therefore, those pressure variations are also indicative of flow quality. That qualitative data may be analyzed in different ways several of which will be described below.

After sixty four samples have been counted at 452 of FIG. 8A, referring to FIG. 8C, the firing pressure state is detected at 600, and a sample complete flag is set at 602. The valid pressure flag is not set at 604; and referring to FIG. 8B, after it is determined that the sample counter is still greater than its maximum count at 500, the sample counter is cleared at 507. Upon again detecting the firing pressure state at 508, the firing pressure sum register is divided by 64 at 510 to determine the average firing pressure over the 64 samples. The process detects that it is not in the calibration mode at 532, and the contents of the firing pressure sum register are copied to a firing pressure average register at 512. Thereafter, the valid sample flag is set at 514; and referring to FIG. 8C, the process moves through steps 600 and 602 and detects the valid sample flag at 604. If, at 606, the firing pressure average value is greater than the high warning pressure limit 606, for example, 765 psi, and is also greater than the high alarm pressure limit 608, for example, 780 psi, an alarm error code is set at 610 which represents a LOW flow of fluid through the dispenser. If the firing pressure average value is not greater than the high alarm pressure limit, a subroutine is executed at 612 which counts consecutive occurrences of the same type of firing pressure quality indicator representing a pressure fault type.

Figure 9:
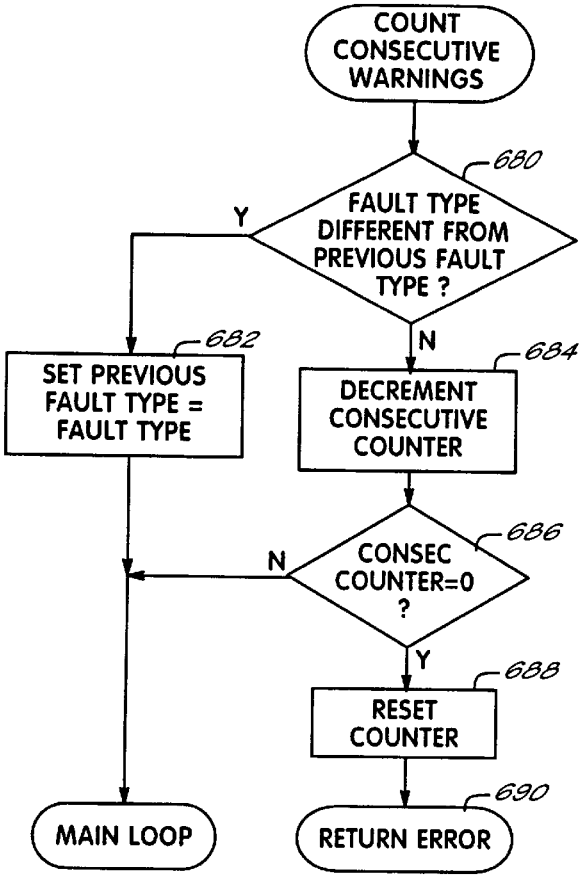
FIG. 9 is a flow chart illustrating the count warnings subroutine executed within the evaluate pressure subroutine of FIG. 8.

Counting consecutive occurrences of the same type of pressure quality indicator, for example, high and low pressure warnings, provides a digital filter that allows the sensitivity of the monitor control to be adjusted. Consequently, the monitor can be made insensitive to spurious changes in flow conditions in the fluid dispenser or erroneous monitoring that may result from occasional electrical noise or interference. Therefore, a warning error code is not produced until there is a continuous and stable pressure condition commanding a warning indication. The above filtering process is not applied to alarm conditions which represent more severe deviations from normal pressure. Referring to FIG. 9, the warning current fault type is compared to the previous warning fault type at 680. If they are different, the previous warning fault type is equal to the current warning fault type at 682; and the process returns to the main routine. If the previous and current warning fault types are the same, the consecutive counter is decremented at 684; and the consecutive counter is tested for a zero state at 686. If the consecutive counter is not zero, the process returns to the main loop. When the consecutive counter reaches zero, it is reset at 688 to a predetermined number, for example, three, which determines the sensitivity of the digital filter, that is, the number of consecutive pressure quality indicators of the same warning fault type that must be counted before an error is returned at 690. Referring back to FIG. 8C, if an error is returned at 614, a warning error code is set at 616 representing low flow of the fluid through the dispenser.

If the firing pressure average value is less than the low warning pressure limit, for example, 735 psi, at 618 and less than the low alarm pressure limit, for example, 700 psi, at 620, then an alarm error code is produced at 622 which represents an excessively high flow of fluid through the dispenser, such as may be caused by a worn nozzle. In a similar manner, if the firing pressure average value is less than the low warning pressure at 618 but equal to or greater than the low alarm pressure limit at 620, consecutive occurrences of that type firing pressure average value are counted at 624. If a predetermined number of the same type of firing pressure average values occur as determined by the subroutine of FIG. 9, a warning code is set at 628 representing an undesirably high flow of fluid through the dispenser.

Continuing with FIG. 8C, if the firing pressure average value is equal to or greater than the low warning pressure limit at 618, the count in the OK counter is tested at 630 for a first predetermined number, for example, 50. During the sampling period, the OK counter at 472 of FIG. 8A counts the occurrences of the acceptable pressure samples. If, during a sampling period, the number of occurrences of the acceptable pressure samples is equal to or less than the first predetermined number of 50 at 630, but is less than a second predetermined number, for example, 20 at 632, an electrical noise alarm error is set at 634. If the number of occurrences of acceptable sample pressure values is equal to or greater than 20 at 632, and the sum of the high and low alarm quality pressure indicators in counters 458, 466, respectively, is greater than a predetermined number, for example, 10, at 636, an electrical noise alarm error is set at 634. However, if the sum of the high and low alarm quality pressure indicators which have been counted is equal to or less than 10 at 636, the consecutive occurrences of that condition is counted 638 by executing the subroutine of FIG. 9; and if an error is returned at 640, an electrical noise warning is set at 642. Thereafter, the process returns to the main routine of FIG. 4. The process steps 600 through 642 described with respect to FIG. 8C represents one analysis of the qualitative data collected during a sampling period. The above analytical process was derived from field experience with a particular system. Some analytical techniques may be generally applied over many systems, while other techniques may be individually tailored for a particular system. The present invention permits the qualitative data to be easily used in many different ways.

The above process is iteratively executed with the control state set to LOW until the end of the timer ON time as illustrated in FIG. 6. When the gun timer turns OFF, that OFF state and the LOW control state are detected at 352 and 368 of FIG. 6; and a subroutine is executed at 370 to initialize the LOW-to-HIGH ("L TO H") pressure transition. The initialize L TO H subroutine resets the LOW control state and sets the L TO H control state. In addition, the L TO H timer and sample counter are reset to zero, and the pressure state is changed to the static pressure. During the next iteration through the main routine and the monitor subroutine, the L TO H control state is detected at 368; and an evaluate turn OFF time subroutine is executed at 376 which evaluates the time to turn OFF the dispensing gun. The subroutine measures the time required for the valve to close which causes the pressure within the fluid dispenser to move from the firing pressure value to the static pressure value.

Figure 10:
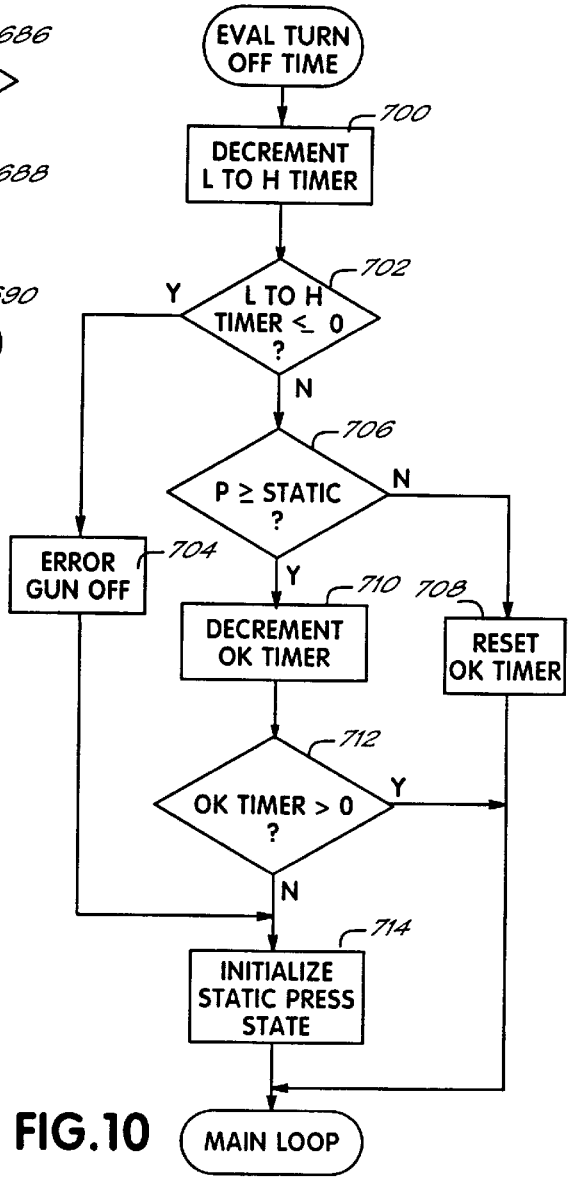
FIG. 10 is a flow chart of the evaluate turn off time. subroutine within the monitor routine illustrated in FIG. 6.

Referring to FIG. 10, the evaluate turn OFF subroutine operates in a similar manner as the evaluate turn ON subroutine illustrated in FIG. 7. The subroutine measures the time, $T_{OFF}$ of FIG. 5, required to close the valve 22 of the gun and change the pressure from the firing pressure to the regulated static pressure. A L TO H timer is set with the maximum acceptable L TO H transition time, for example, 25 milliseconds and is decremented at 700 with each iteration through the subroutine. If the L TO H timer times out at 702 prior to the pressure rising to an acceptable static pressure, for example, the static pressure high alarm pressure limit, for example, 780 psi, a gun OFF, or, a turn OFF time, error code is produced at 704. The gun OFF error code indicates that the pressure did not change to an acceptable static value within the expected transition time of 25 milliseconds. If the L TO H timer continues to be greater than zero at 702, a predetermined number, for example, four, pressure values that are greater than or equal to the acceptable static pressure are counted at 706, 708, 710 through successive iterations of the subroutine as described with respect to FIG. 7, If four acceptable static pressure values are detected at 712, the static pressure state is initialized which resets L TO H control state, sets the HIGH control state and resets the L TO H and OK timers to zero.

During the next iteration through the monitor subroutine 306 of FIG. 6, the HIGH control state is detected at 368; and the memory locations in the monitor controller which contain the static parameters are read at 380. Thereafter, the evaluate pressure subroutine illustrated in FIGS. 8A–8C is executed at 382. The static pressure is evaluated by sampling 64 static pressure measurements and comparing those sampled values to static pressure high and low alarm limits. Static pressure samples which either are acceptable or which exceed the high or low alarm limits are counted during the sampling period. An average of the static pressure during the sampling period is also determined. That qualitative data is then analyzed in a similar way as the qualitative firing pressure data.

Referring to FIG. 8A, the static pressure state is detected at 454; and the sampled static pressure value "SP" is tested against the static pressure high alarm limit at 474, for example, 835 psi. If it exceeds the limit, the high alarm counter is incremented at 476, thereby counting static pressure quality indicators representing the number of static pressure samples during the sampling period that exceed the static pressure high alarm limit. If the measured static pressure is not greater than the static pressure high alarm limit, but it is less than the low alarm pressure limit at 478, for example, 765 psi, static pressure low alarm quality indicators presenting sampled static pressures less than the low alarm limit are counted by incrementing the static pressure low alarm counter at 480. Otherwise, acceptable static pressure quality indicators representing acceptable sampled values of static pressure are counted by incrementing the OK counter at 482.

Thereafter, referring to FIG. 8B, upon detecting the static pressure state at 502, the current sampled static pressure value is added at 506 to a register representing the cumulative sum of all static pressures detected during the sampling period. The sampling process continues, until in FIG. 8A, the end of the sampling period is detected at 452. Referring to FIG. 8C, in the absence of a valid sample flag at 650, the subroutine in FIG. 8B divides the contents of the static pressure sum register by 64 at 520 to create a static pressure average value; and the contents of the static pressure sum register are copied to the static pressure average register at 522. The contents of the static pressure sum register are then cleared; and the valid sample flag is set at 524.

Referring to FIG. 8C, after passing through steps 600 and 650, if the average static pressure value determined at 520 of FIG. 8B is greater than the static pressure high alarm limit at 651, for example, 835 psi, an error code is set at 652 representing a static pressure high alarm. Further, if the calculated static pressure average value is less than the static pressure low alarm limit at 653, for example, 765 psi, an error code is set at 654 representing a static pressure low alarm. If the static pressure average value is within the high and static pressure low alarm limits, but, if the count in the static pressure high alarm counter 476 of FIG. 8A is greater than a predetermined high alarm count, for example, two, at 655, a static pressure high alarm error code is set at 656. If the number of static pressure low alarm quality indicators counted by the static pressure low alarm counter 480 of FIG. 8A is greater than a predetermined number of low alarm counts, for example, two, at 657, the number of static pressure high alarm quality indicators are again compared to a predetermined number of high alarm counts at 658. If the process detects that both the high and static pressure low alarm quality indicators is greater than their respective predetermined counts at 657 and 658, then an electrical noise alarm error code is set at 659. During a sampling period of the static pressure, pressures exceeding both the high and low alarm pressure limits during a sampling of the static pressure would not be expected to occur. Therefore, if such a condition is detected, the probability is that the condition is being caused by electrical noise. If only the static pressure low alarm quality indicators exceed their predetermined count then a static pressure low alarm error code is set at 660. Thereafter the process returns to the main routine illustrated in FIG. 4.

The monitor subroutine of FIG. 6 tests for two additional error conditions. Referring to FIG. 6, during the gun timer ON time, it is not logical to expect an L TO H control state representing a closure of the gun valve which turns the gun OFF. Similarly, during the gun timer OFF time, it is not logical to expect an H TO L control state which requires that the gun valve open to turn the gun ON. Even though the above conditions should not logically occur, such conditions are possible because of a failure within the control, for example, a malfunction of a timer or other component could produce such logic states. Therefore, when the gun timer is ON, if the L TO H control state is detected, an error code is set at 384 representing a timer turn ON error. Further, the L TO H control state is reset and the LOW control state is set. Similarly, if the gun timer is OFF and an H TO L control state is detected at 368, an error code representing a timer turn OFF error is set at 388. Further, the H TO L control state is reset, and the HIGH control state is set.

Fluid Flow Diagnostics

During the execution of the monitor subroutine of FIG. 6 within the monitor controller 224, as previously explained, fluid flow conditions through the fluid dispensing gun are detected that result in the generation of fluid flow condition signals, or data, that may include error codes representing warning and or alarm conditions. Those error codes are transferred from the monitor controller 224 to the MC communication processor 232 and stored in memory 234 pursuant to the process at step 312 of FIG. 4. Upon receiving each error code, the MC communications processor also obtains time and date information from the processor 242 and stores that information with each of the error codes. In a subsequent data transfer cycle between processor 232,242, the error codes are transferred to the operator controller 220 and stored in memory 244 for display to the operator on display 254. The OC communications processor 242 also stores a history of error codes for each of the guns, for example, the last twelve error codes generated for each of the guns. The LCD display may, for example, be an eight line by 40 character display. The operator control 220 is designed such that each of the pushbuttons 248 is positioned adjacent one end of each of the 40 character display lines. Further, approximately five characters at each end of those display lines is used to provide a label for the associated pushbutton. The remaining 30 characters with each of those display lines are used to display the states of operating parameters. For example, the pushbuttons on the left side of the LCD display displays labels identifying four fluid dispensing guns by number, for example, gun #1, gun #2, etc. Further, the messages associated with each of the guns selectively displays the static pressure, the total number of cans coated by that gun, a user defined label for the gun, and warning and alarm messages corresponding to respective stored warning and alarm error codes. If the display has a warning message associated with a particular gun, that line of the display is highlighted; and a pushbutton located on the right side of the display has a "help" label. Selecting the "help" button will initiate the transfer of additional data associated with the error code to be read from the memory 234 and transferred from the MC communications processor 232 to the OC communications processor 242 during the next data transfer cycle between those processors. The additional data typically identifies nature of the error code, for example, low flow, and potential causes of the error condition. Therefore, actuating the "help" pushbutton generates a new display which identifies the fluid dispensing gun being examined, identifies the nature of the warning message and provides a list of probable causes for the alarm and warning messages.

More specifically, for any dispensing gun, the display may indicate one of several equivalent error messages which are derived from a firing pressure less than the low alarm limit, such as, for example, "firing pressure low alarm" or "firing pressure high flow alarm", etc. By selecting the line displaying the error message and selecting the "help" pushbutton, a new display is presented that lists the probable causes of the error message, for example, a worn nozzle, a clogged component, low static pressure, etc. By selecting the line displaying clogged component and depressing the "help" pushbutton, the identity of components is displayed that may be clogged, for example, the calibration plate orifice, the heaters, the filters, etc. Similarly, if the dispensing gun has a firing pressure in excess of the high alarm limit, the display message may be "firing pressure high alarm" or "firing pressure low flow". The "help" pushbutton may be used to advise the operator that the alarm may be caused by a clogged nozzle, a worn calibration orifice plate, a high static pressure, etc. If the display indicates a static pressure high alarm and the "help" pushbutton is again pushed, the display presents to the operator probable causes of that error code. For example, the pressure regulator may be set too high; the pressure regulator may be faulty; etc. Other error codes may advise the operator that electrical noise may be causing a problem.

Fluid Monitor Calibration

In use, the operation of the monitor control must be calibrated for each particular fluid dispenser. In other words, for a fluid dispenser to discriminate abnormal fluid flow conditions in the dispenser from a normal fluid flow condition, a base line of normal operation must be established. That is, the process must determine what measured values of static and firing pressures correlate to acceptable fluid flow through the dispensing gun that represent satisfactory gun operation. To do this, the calibration process measures calibration static and firing pressure values over a predetermined number of sample cans. If the calibration static and firing pressure values are within acceptable limits, those values are used to calculate the high and low alarm and warning pressure limits. The pressure, in the dispenser when the gun is opened is a function first, of nozzle size which is proportional to the desired flowrate of fluid. Second, pressure in the gun is also a function of the static pressure of the fluid supplied from a fluid source which may be preset and varied with a pressure regulator. Third, a plate with a calibrated orifice is placed in the fluid stream upstream from the pressure transducer, with the pressure transducer being placed between the orifice plate and the nozzle. The size of the calibrated orifice is also a factor affecting the pressure sensed by the transducer. Given data relating to nozzle size, static pressure and the size of the calibrated orifice, a theoretical firing pressure value to be measured by the pressure transducer is determined. Then, the theoretical firing pressure value is compared to actual measurements of firing pressure to determine whether the fluid dispensing gun is operating within expected parameters.

Figure 11:
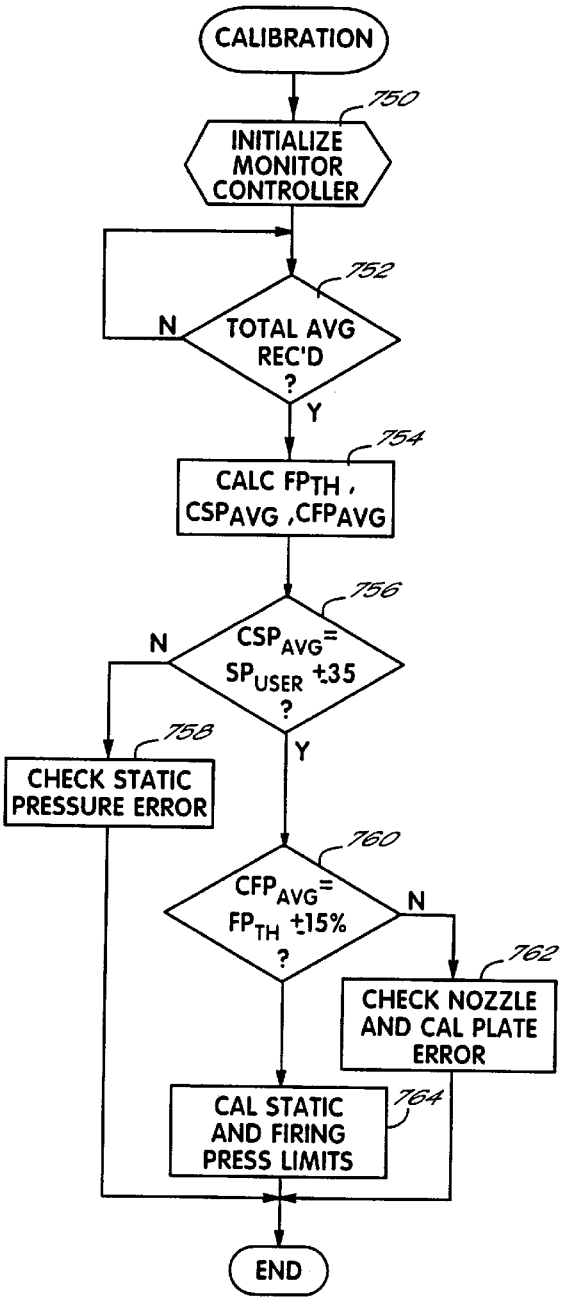
FIG. 11 is a flow chart of the calibration subroutine executed by the communications processor within the monitor control.

Referring to FIG. 3, the memory 234 within the MC communication processor 232 contains default values representing nozzle size, desired static pressure and the identity of a calibrated orifice. An operator may use the pushbuttons 248 on the operator control 220 to modify those default values in the memory 234 so that those values correspond to the actual nozzle size, actual static pressure and the actual calibrated orifice used with the fluid dispensing gun. Thereafter, the operator may use one of the pushbuttons 248 to initiate a calibration mode of operation for the monitor control. The calibration mode is effective to measure the actual firing pressure and compare it to a theoretical firing pressure. Referring to FIG. 11, a calibration subroutine is executed by the MC communication processor 232 in response to the calibration mode being selected by one of the pushbuttons 248. The calibration subroutine first initializes at 750 the monitor controller. Data is transmitted across the link 236 to the monitor controller 224 which sets the monitor controller 224 to the calibration mode and further initializes the calibration mode within the monitor controller 224. For example, static and firing calibration can counters are set to a predetermined number, for example, four, which determines the number of cans over which calibration data will be taken.

The calibration operation measures firing and static pressures during the coating of the predetermined number of cans. Therefore, the previously described processes for monitoring the coating process and evaluating pressure pursuant to FIGS. 4–10 are executed. Referring to FIG. 8A, with each sample, the calibration mode is detected at 451; and referring to FIG. 8B, the static and firing pressures read at 350 of FIG. 6 are added to a pressure sum registers 504, 506. When, after 64 samples, the sample counter reaches its maximum count at 500, depending on whether the static or firing pressure states are active at 508, average pressure values are calculated at 520 and 510, respectively; the calibration mode is detected at 530, 532; and the average pressure values in the sampled pressure sum registers are added to respective pressure average registers at 538, 540. In addition, the sum registers 506, 504 are cleared, and the calibration can counter is decremented at 542, 544. Thereafter, the above calibration pressure monitoring is iterated until the static and firing calibration can counters count the predetermined number of cans coated in the calibration process and go to zero at 542, 544. At that time, the calculation of the calibration static and firing pressure averages is detected as being complete at 546, 548; and the calibration mode is reset or cleared at 550 within the monitor controller 224. A subroutine is executed at 552 to send the calibration static and firing pressure average values from the monitor controller 224 across the data link 236 to the MC communication processor 232. Thereafter, the control state is set HIGH at 554. The purpose of the above process is to measure the actual firing and static pressure values for a given gun and set of process parameters. Up to this point, the calibration mode has taken 64 firing and static pressure samples over four cans, summed together the 256 static pressure sample values, summed together the 256 firing pressure sample values and divided each of the two sums by 64. The result is average static and firing pressure values over four cans.

Referring to FIG. 11, the calibration subroutine detects at 752 that the averages have been received; and proceeds to calculate at 754 the various pressure values. First, given the user set static pressure "SP", the nozzle flowrate which is determined by the nozzle size and the calibration plate designation number which is determined by calibration plate orifice size, a theoretical firing pressure value is calculated according to the following:

$$FP_{THEORETICAL} = (SP)\frac{(\text{Nozzle Flowrate})^2}{(\text{Nozzle Flowrate})^2 + 9(Cal.\ \text{Plate No.})}$$

Next, the average calibration static pressure value per can is determined by dividing the average static pressure value received from the monitor controller 224 by four, the number of cans coated during the calibration mode. Similarly, the average calibration firing pressure value is also determined in the same way. The average calibration static pressure value is then compared to the static pressure set by the user at 756. The process permits the average calibration static pressure value to vary from the static pressure established by the user by a predetermined tolerance, for example, plus or minus 35 psi. If the average calibration static pressure value is not within the permissible pressure envelope, an error code is set at 758 advising the operator to check the static pressure.

The average calibration firing pressure value is then compared to the calculated theoretical firing pressure value at 760. Again, a tolerance band above and below the theoretical firing pressure value is utilized. For example, a average calibration firing pressure value which is within plus or minus 15% of the theoretical firing pressure value is acceptable. If the average calibration firing pressure value is outside the acceptable pressure bandwidth, an error code is set at 762 advising the operator to check the nozzle and the calibration plate. If the average calibration static and firing pressure values are within the respective tolerances, then those values are used to calculate static alarm and firing alarm and warning pressure limits at 764. The limits are calculated by the monitor controller 224 and stored in registers 230 within the controller 224. In addition, time and date information is received from the operator control 220 and stored with the calculated limits. As part of the process at 264, the newly calculated limits are transferred to the OC communications processor 242 and stored in the nonvolatile memory 244. The processor 232 stores in memory 234 a history of sets of calibration parameters with associated time and date data, for example, six sets of calibration parameters. However, since memory 234 is volatile, the history of calibration parameters is lost when power is removed from the monitor control 14.

Pursuant to the process at 264, the high and low static alarm pressure limits are set to values that are a predetermined amount, for example, 35 psi, above and below, respectively, the average calibration static pressure value. For example, if the average calibration static pressure value is 800 psi, the high and low static alarm pressure limits are set to 835 psi and 765 psi, respectively.

Further, the firing pressure high and low warning pressure limits are set to values that are predetermined amounts above and below, respectively, the average calibration firing pressure value. For example, if the average calibration firing pressure value is 750 psi, the normal calibrated orifice firing pressure drop is 50 psi. The firing pressure high warning limit may be set to 765 psi which produces a firing pressure drop across the calibrated orifice will be 35 psi, that is, 30% less than its normal pressure drop of 50 psi. Similarly, the firing pressure low warning limit may be set to 735 psi which results in a calibrated orifice pressure drop of 65 psi or 30% above its normal value. The firing pressure high and low alarm pressure limits are set to values that are predetermined amounts above and below, respectively, the average calibration firing pressure value. For example, the firing pressure high alarm limit may be set to 780 psi which results in a calibrated orifice pressure drop of 20 psi, that is, 60% less than its normal pressure value. The firing pressure low alarm limit may be set to 700 psi resulting in a calibrated orifice pressure drop of 100 psi which is 100% greater than its normal value. From the above, it should be noted that the high and low alarm and warning pressure limits do not have to be symmetrical. After the static and firing pressure limits have been calculated at 764 of FIG. 11, they are stored in the registers 230 of the monitor controller 224. The monitor control also requests from the operator control the date and time that the calibration process was executed, and that time and date are stored in association with the set of calculated pressure limits. The current set and a history of a predetermined number of the prior sets of calculated pressure limits, for example, the last four sets of calculated pressure limits, and their associated time and date are stored in the memory 234 associated with the MC communications processor 232.

While the invention has been set forth by a description of the embodiment in considerable detail, it is not intended to restrict or in any way limit the claims to such detail. Additional advantages and modifications will readily appear to those who are skilled in the art. For example, PC unit or other computer may be connected to the network to provide other functions, for example, statistical process control analysis may be performed on the monitored data to help optimize process parameters. Further, the PC can be used to provide a nonvolatile storage of data that has been described as being in a volatile store, or the PC may be used to store more of a history of data or other process parameters. As another example, the gun timer in the above description provides an intermittent signal to turn the dispensing gun ON and OFF in response to objects being conveyed past the dispensing gun. Alternatively, the gun timer may provide a timing signal which is maintained ON continuously for an extended period while objects are conveyed past the fluid dispenser. In that situation, the monitor control would continuously execute the evaluate pressure subroutine 362 to provide the same monitoring function until the gun is turned OFF.

The evaluate pressure subroutine of FIGS. 8A–8C illustrates various strategies for determining alarm and warning error codes in response to detecting individual sampled pressures or average pressure values that exceed the alarm and warning pressure limits. Many different strategies may be employed. For example, referring to FIG. 8C, in testing the static alarm pressure limits, the subroutine compares the static pressure average value determined during a sampling period to the high and static pressure low alarm limits. In addition, static pressure alarm error codes are generated if predetermined numbers of sampled static pressure values exceed the high and low alarm pressure limits. Alternatively, either one of the above strategies may be used to the exclusion of the other.

Similarly, in the subroutine description, the processes of producing alarm and warning error codes in response to sampling the firing pressure during the gun ON time may be similarly varied. For example, the number of acceptable sample pressures in the firing pressure OK counter may be varied. Further, the counting of consecutive quality indicators to provide a digital filtering may be varied or eliminated.

Figure 12:
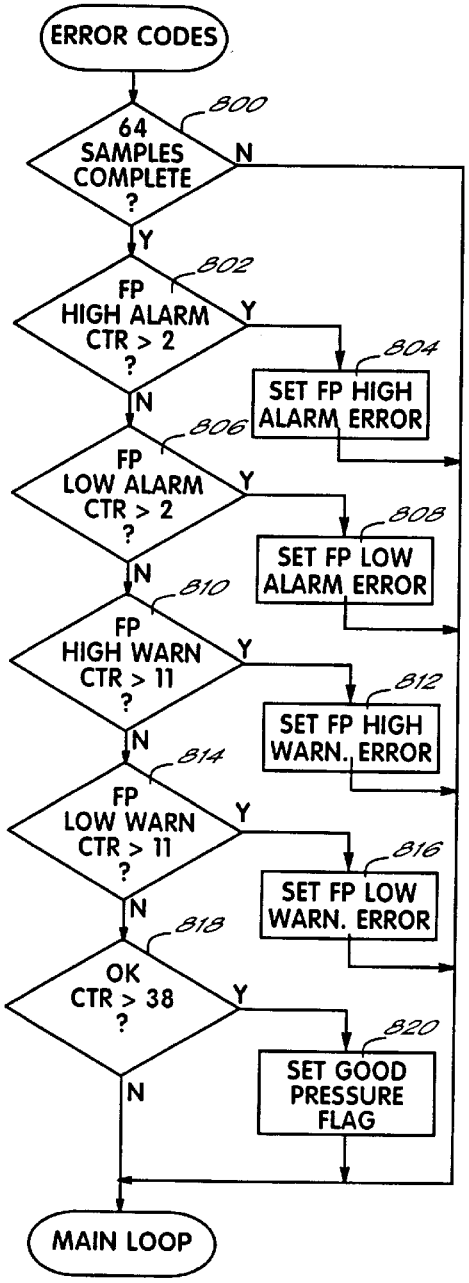
FIG. 12 is a flow chart illustrating a process of generating error codes as a function of a Gaussian distribution of values of pressure samples taken over a sampling period.

Further, high and low alarm and warning error codes may be produced in response to the high and low alarm and warning counters detecting a frequency of occurrence of respective quality indicators associated with the counters that which is then compared with a normal, that is, Gaussian, distribution. For example, referring to FIG. 12, given a sampling period of 64 samples, after completion of the sampling period is detected at 800, the process, at 802, determines whether the count in the firing pressure high alarm counter is greater than a predetermined number, for example, two, which represents the second standard deviation for 64 samples. If the count is greater than two, the firing pressure high alarm error code is set at 804. Similarly, if, at 806, the firing pressure low alarm counter has a count exceeding the second deviation of 64 samples, that is, two, the firing pressure low alarm error code would be set at 808. If the count in the firing pressure high warning counter is greater than another predetermined number, for example, eleven, at 810, which is the first standard deviation of 64 samples, the firing pressure high warning error code would be set at 812. Similarly, if the firing pressure low alarm counter exceeds eleven counts as detected at 814, the firing pressure low warning error code is set at 816. If, as detected at 818, the count in the firing pressure OK counter is equal to or exceeds thirty eight which, for 64 samples, is the minimum number of good samples in the absence of an error condition, then the pressure in the dispensing gun is considered to be normal; and a normal pressure flag is set at 820. The above described pressure analysis utilizing a Gaussian distribution of occurrences of the pressure quality indicators may be used in association with or to the exclusion of different segments of the process illustrated in FIG. 8C for analyzing the firing pressure value.

The invention therefore in its broadest aspects is not limited to the specific details shown and described. Accordingly, departures may be made from such details without departing from the spirit and scope of the invention.

What is claimed is:

1. A monitoring system for monitoring fluid flow conditions in a fluid dispensing system controlling flow of a fluid through a plurality of fluid dispensers comprising:

a plurality of sensors, each of the sensors operatively associated with one of the fluid dispensers, and each sensor providing an input signal having values representing a characteristic of fluid flow through a respective one of the fluid dispensers;

a plurality of monitor controls, each monitor control connected to only one of the plurality of sensors and each monitor control producing, in response to the input signal from a respective one of the plurality of sensors, output signals representing fluid flow characteristics associated with the respective one of the plurality of fluid dispensers, and one of the output signals resulting in a change of operation of the respective one of the plurality of fluid dispensers; and an operator control in electrical communication with the plurality of monitor controls and not directly connected to the fluid dispensers, the operator control being responsive to the output signals from the monitor controls.

2. The monitoring system of claim 1 further including a data communications network connecting the plurality of monitor controls with the operator control for providing the electrical communication therebetween.

3. The monitoring system of claim 1 wherein each of the monitor controls further comprising:

a memory for storing a plurality of reference signals;

a data processor connected to the memory for producing the output signals in response to periodically comparing one of the input signals with at least one of the plurality of reference signals; and a first communications processor in electrical communication with the data processor and the data communications network.

4. The monitoring system of claim 3 wherein the operator control comprises:

input devices for providing input data signals;

a display device; and a second communications processor electrically connected to the input devices and the display device and the data communications network.

5. The monitoring system of claim 4 wherein the data communications network further comprises:

a first interface located with each of the monitor controls and in electrical communication with the communications processor;

a second interface located with the operator control and in electrical communication with the second communications processor; and a communications link in electrical communication with the first and second interfaces for transmitting data between the first and second interfaces.

6. The monitoring system of claim 4 wherein the first and the second communications processors are "NEURON CHIP" processors.

7. The monitoring system of claim 1 wherein each of the plurality of monitor controls is remotely located from the respective one of the plurality of sensors a distance in the range of up to 100 feet.

8. The monitoring system of claim 1 wherein the operator control is remotely located from each of plurality of monitor controls a distance in the range of up to 5000 feet.

9. The monitoring system of claim 1 further including a plurality of operator controls in electrical communication with the plurality of monitor controls and responsive to the output signals from the monitor controls for selectively displaying data relating to fluid flow through respective ones of the plurality fluid dispensers.

10. The monitoring system of claim 1 wherein the plurality of sensors is a plurality of pressure sensors.

11. A monitoring system for monitoring fluid flow conditions in a fluid dispensing system controlling flow of a fluid through a fluid dispenser, the characteristic of fluid flow being represented by an input signal produced by a sensor operatively associated with the fluid dispenser, the monitoring system comprising:

a memory for storing an alarm limit value of the characteristic of fluid flow and a warning limit value of the characteristic of fluid flow, the warning limit value having a magnitude between the alarm limit value and an acceptable value of the characteristic of fluid flow through the fluid dispenser; and a processor responsive to the input signal from the sensor and the alarm and warning limit values, the processor being operatively associated with the fluid dispenser for periodically sampling during a sampling period the input signal to detect sampled values of the characteristic of fluid flow, comparing each sampled value to the alarm and warning limit values, and producing a warning error code in response to predetermined relationships between the sampled values and the alarm and warning limit values.

12. The monitor system of claim 11 wherein the sensor produces an input signal representing pressure of the fluid in the fluid dispenser.

13. The monitor system of claim 12 wherein the processor produces the warning error code in response to a predetermined number of sampled values being less than the alarm limit value and greater than the warning limit value.

14. The monitoring system of claim 12 wherein the processor produces the warning error code by determining an average pressure value in response to the sampled pressure values detected during the sampling period; and comparing the average pressure value to the alarm and warning pressure limit values; and producing the warning error code in response to the average pressure value being between the warning limit value and the alarm limit value.

15. A monitoring system for monitoring fluid flow conditions in a fluid dispensing system controlling flow of a fluid through a fluid dispenser, the characteristic of fluid flow being represented by an input signal produced by a sensor operatively associated with the fluid dispenser, the monitoring system comprising:

a memory for storing a reference value representing an acceptable pressure value during an ON time period during which fluid is being dispensed through the fluid dispenser; and a processor responsive to the input signal from the sensor and the reference value, the processor being operatively associated with the fluid dispenser for periodically sampling the input signal from a start of the ON time period to produce sampled values of the pressure of the fluid in the fluid dispenser, periodically comparing the sampled values of the input signal with the reference value representing an acceptable pressure value during the ON time period, measuring a turn ON transition time period from the start of the ON time period, and producing a turn ON time error code in response to the turn ON transition time period exceeding a value of a reference turn ON transition time prior to a sampled value of the input signal being approximately equal to the reference pressure value.

16. The monitoring system of claim 15 wherein the processor produces the turn ON time error code by comparing in response to each periodic sample of the input signal, the turn ON transition time to the reference turn ON transition time; and detecting the turn ON transition time exceeding the reference turn ON transition time prior to a predetermined number of sampled values of the input signal being approximately equal to the reference value.

17. A monitoring system for monitoring fluid flow conditions in a fluid dispensing system controlling flow of a fluid through a fluid dispenser, the characteristic of fluid flow being represented by an input signal produced by a sensor operatively associated with the fluid dispenser, the monitoring system comprising:

a memory for storing a reference value representing an acceptable pressure value during an OFF time period during which fluid is not being dispensed from the fluid dispenser; and a processor responsive to the input signal from the sensor and the reference value, the processor being operatively associated with the fluid dispenser for periodically sampling the input signal from a start of the OFF time period to produce sampled values of the pressure of the fluid in the fluid dispenser, periodically comparing the sampled values of the input signal with a reference value representing an acceptable pressure during the OFF time period, measuring a turn OFF transition time period from the start of an OFF time period, and producing a turn OFF time error code in response to the turn OFF transition time period exceeding a value of a reference turn OFF transition time prior to a sampled value being approximately equal to the reference value.

18. The monitoring system of claim 17 wherein the processor produces the turn ON time error code by comparing in response to each periodic sample of the input signal, the actual turn OFF transition time to the reference turn OFF transition time; and detecting the actual turn OFF transition time exceeding the reference turn OFF transition time prior to a predetermined number of sampled values of the input signal being approximately equal to the reference value.

19. A monitoring system for monitoring fluid flow conditions in a fluid dispensing system controlling flow of a fluid through a fluid dispenser, the characteristic of fluid flow being represented by an input signal produced by a sensor operatively associated with the fluid dispenser, the monitoring system comprising:

a memory for storing an alarm limit value representing a limit of an acceptable range of pressures of the fluid during an OFF time period during which fluid is not being dispensed through the fluid dispenser; and a processor responsive to the input signal from the sensor and the reference value, the processor being operatively associated with the fluid dispenser for periodically sampling the input signal over a sampling period during the OFF time period to detect sampled values of the pressure, periodically comparing the sampled values to the alarm limit value, and producing a static pressure alarm error code in response to predetermined relationships between sampled values and the alarm limit value.

20. The monitoring system of claim 19 wherein the processor produces the static pressure alarm error code by determining an average static pressure value in response to the sampled values detected during the sampling period; and comparing the average static pressure value to the alarm limit value; and producing the static pressure alarm error code in response to the average static pressure value exceeding the limit of an acceptable range of pressures of the fluid during the OFF time period.

21. A monitoring system for monitoring fluid flow conditions in a fluid dispensing system controlling flow of a fluid through a plurality of fluid dispensers comprising:

a plurality of pressure sensors, each of the pressure sensors operatively associated with one of the fluid dispensers, and each pressure sensor providing an input signal having values representing a fluid flow pressure through a respective one of the fluid dispensers;

a plurality of monitor controls, each monitor control connected to only one of the plurality of pressure sensors and each monitor control producing, in response to the input signal from a respective one of the plurality of pressure sensors, output signals representing fluid flow characteristics associated with the respective one of the plurality of fluid dispensers; and an operator control in electrical communication with the plurality of monitor controls and not directly connected to the fluid dispensers, the operator control being responsive to the output signals from the monitor controls.

* * * * *

UNITED STATES PATENT AND TRADEMARK OFFICE

CERTIFICATE OF CORRECTION

PATENT NO. : 5,808,559
DATED : September 15, 1998
INVENTOR(S) : Buckler

It is certified that error appears in the above-indentified patent and that said Letters Patent is hereby corrected as shown below:

In the Abstract

In the last line of the Abstract, before "attaching", delete "a".

In column 1, line 66, before "alarm", delete "a".
In column 5, line 48, delete "FIG.", and insert therefor --FIGS.--.
In column 5, line 53, after "time" delete ".".
In column 6, line 39, delete "provide", and insert therefor -- provides--.
In column 7, line 11, after "end" insert "of".
In column 12, line 37, delete "warring", and insert therefor --warning--.
In column 15, line 52, delete "64", and insert therefor --sixty four--.
In column 17, line 56, delete "64", and insert therefor --sixty four--.
In column 21, line 17, delete "64", and insert therefor --sixty four--.
In column 21, line 40, delete "64", and insert therefor --sixty four--.
In column 23, lines 52, 57, 60 and 64; delete "64", and insert therefor --sixty four--.
In column 24, line 3, delete "64", and insert therefor --sixty four--.
In column 19, line 18, delete "and or", and insert therefor --and/or--.
In column 22, line 8, delete "a", and insert therefor --an--.
In column 22, line 44, delete "will be", and insert therefor --of--.

(Cont...)

UNITED STATES PATENT AND TRADEMARK OFFICE

CERTIFICATE OF CORRECTION

PATENT NO. : 5,808,559
DATED : September 15, 1998
INVENTOR(S) : Buckler

It is certified that error appears in the above-indentified patent and that said Letters Patent is hereby corrected as shown below:

In the Claims

In claim 3, column 24, line 44, delete "comprising", and insert therefor --comprises--.

In claim 18, column 26, line 57, delete "ON", and insert therefore --OFF--.

In claim 20, column 27, line 24, after "period;", delete "and".

Signed and Sealed this

Tenth Day of August, 1999

*Attest:*

Q. TODD DICKINSON

*Attesting Officer*

*Acting Commissioner of Patents and Trademarks*